US011591840B1

(12) United States Patent
Plummer et al.

(10) Patent No.: US 11,591,840 B1
(45) Date of Patent: Feb. 28, 2023

(54) POWER WINDOW OPERATORS, WINDOWS AND METHODS

(71) Applicant: ANDERSEN CORPORATION, Bayport, MN (US)

(72) Inventors: David Plummer, Hudson, WI (US); Chad Wernlund, Baldwin, WI (US); Justin Depew, Stillwater, MN (US); Matthew Page, Cottage Grove, MN (US)

(73) Assignee: ANDERSEN CORPORATION, Bayport, MN (US)

( * ) Notice: Subject to any disclaimer, the term of this patent is extended or adjusted under 35 U.S.C. 154(b) by 0 days.

(21) Appl. No.: 17/080,893

(22) Filed: Oct. 27, 2020

Related U.S. Application Data

(60) Provisional application No. 62/928,411, filed on Oct. 31, 2019.

(51) Int. Cl.
*E05F 15/00* (2015.01)
*E05F 15/63* (2015.01)
*E05B 65/06* (2006.01)

(52) U.S. Cl.
CPC ..... *E05F 15/63* (2015.01); *E05B 65/06* (2013.01); *E05Y 2201/22* (2013.01); *E05Y 2201/246* (2013.01); *E05Y 2201/41* (2013.01); *E05Y 2201/422* (2013.01); *E05Y 2201/624* (2013.01); *E05Y 2201/68* (2013.01); *E05Y 2201/682* (2013.01); *E05Y 2201/722* (2013.01); *E05Y 2800/11* (2013.01); *E05Y 2900/148* (2013.01)

(58) Field of Classification Search
CPC . E05F 11/34; E05F 11/14; E05F 11/16; E05F 11/145; E05F 15/63; E05C 9/063; E05Y 2201/71; E05Y 2201/24; E05Y 2201/22; E05Y 2900/148; E05Y 2800/296; E05Y 2201/246; E05Y 2201/41; E05Y 2201/422; E05Y 2201/624; E05Y 2201/68; E05Y 2201/682; E05Y 2201/722; E05Y 2800/11; E05B 65/06
USPC ..... 49/341, 340, 342, 343, 339, 348, 349, 49/350, 324
See application file for complete search history.

(56) References Cited

U.S. PATENT DOCUMENTS

| | | | |
|---|---|---|---|
| 2,114,645 | A | 1/1938 | Benschoten |
| 2,709,582 | A | 1/1955 | Chapman |
| 4,497,135 | A | 2/1985 | Vetter |
| 4,617,758 | A | 10/1986 | Vetter |
| 4,887,392 | A | 12/1989 | Lense |
| 5,097,629 | A | 3/1992 | Guhl et al. |
| 5,199,216 | A | 4/1993 | Vetter et al. |
| 5,205,074 | A | 4/1993 | Guhl et al. |
| 5,226,256 | A | 7/1993 | Fries et al. |
| 5,531,045 | A | 7/1996 | Piltingsrud |
| 5,623,784 | A | 4/1997 | Kuersten et al. |

(Continued)

FOREIGN PATENT DOCUMENTS

WO 2015140667 9/2015

*Primary Examiner* — Chi Q Nguyen
(74) *Attorney, Agent, or Firm* — Mueting Raasch Group

(57) ABSTRACT

Power window operators, windows including the power window operators, and methods of using the same are described herein. The power window operators may offer the ability to control the timing and/or speed of the lock/unlock motion relative to the open/close motions of the operator arm of the power window operator and, if provided, a sash being driven by the power window operator.

23 Claims, 13 Drawing Sheets

(56) References Cited

U.S. PATENT DOCUMENTS

| | | | | |
|---|---|---|---|---|
| 5,813,171 | A | 9/1998 | Piltingsrud | |
| 6,122,863 | A | 9/2000 | Tippin et al. | |
| 6,367,853 | B1 * | 4/2002 | Briggs | E05C 9/025 74/544 |
| 6,915,608 | B2 | 7/2005 | Labarre | |
| 7,013,604 | B1 | 3/2006 | Moody et al. | |
| 7,452,014 | B2 | 11/2008 | Vetter | |
| 7,708,322 | B2 | 5/2010 | Timothy et al. | |
| 8,418,404 | B2 | 4/2013 | Gramstad et al. | |
| 8,677,689 | B1 | 3/2014 | Draper et al. | |
| 9,217,266 | B2 | 12/2015 | Bauman | |
| 9,797,176 | B2 | 10/2017 | Balbo Di Vinadio | |
| 10,876,343 | B2 * | 12/2020 | Erickson | E05F 11/10 |
| 11,002,057 | B1 * | 5/2021 | Micinski | E05F 15/622 |
| 2006/0032143 | A1 * | 2/2006 | Johnson | E05F 11/382 49/341 |
| 2006/0241126 | A1 * | 10/2006 | Elliott | C07D 401/12 514/258.1 |
| 2016/0130847 | A1 | 5/2016 | Gramstad et al. | |

* cited by examiner

POWER WINDOW OPERATORS, WINDOWS AND METHODS

RELATED APPLICATION

This application claims the benefit under 35 U.S.C. Section 119 of U.S. Provisional Patent Application Ser. No. 62/928,411 entitled "POWER WINDOW OPERATORS, WINDOWS AND METHODS" as filed on Oct. 31, 2019, which is incorporated herein by reference in its entirety.

Power window operators, windows including the power window operators, and methods of using the same are described herein.

BACKGROUND

Hinged windows (e.g., casement windows, awning windows, etc.) include one or more movable sashes in a frame, wherein the movable sash or sashes can be rotated to open and close the window. Such windows typically include lock mechanisms to prevent unwanted opening of the sash or sashes when the window is closed.

SUMMARY

Power window operators, windows including the power window operators, and methods of using the same are described herein. In one or more embodiments, the power window operators offer the ability to control the timing and/or speed of the lock/unlock motion relative to the open/close motions of the operator arm of the power window operator and, if provided, a sash being driven by the power window operator.

In one or more embodiments, the relative speed of the lock/unlock motion as compared to the speed of the open/close motion of an operator arm of the power window operator is fixed when the power window operator is assembled such that the relative speeds remain substantially constant throughout the life of the power window operator.

In one or more embodiments, the power window operator is configured such that the lock/unlock motion of a lock operator unlocks a sash lock assembly connected to the lock operator before opening a sash that is in the closed position. Unlocking of the sash lock assembly before opening the sash keeps the sash lock assembly from inhibiting opening of the sash—which would occur if the sash lock assembly is still in a locked configuration when the sash starts to open.

In one or more embodiments, the power window operator is configured such that the lock/unlock motion locks a sash lock assembly after closing a sash such that closing of the sash is not inhibited by the sash lock assembly (which may be useful for windows in which a locked sash lock assembly could prevent proper closing of a sash).

In one or more embodiments, the power window operator may offer a combination of powered or motorized operation in addition to manual operation, with the opportunity for a user to switch between motorized operation and manual operation as needed. The need for manual operation may arise, for example, if the motorized portion of the drive system becomes disabled, etc.

In one or more embodiments, the power window operators described herein may switch between motorized or manual operation without requiring specific knowledge on the part of a user who may or may not have access to automation control devices used to operate the power window operator using the motor of the power window operator.

In a first aspect, one or more embodiments of a power window operator as described herein may include: a housing configured for attachment to a window frame; a motor operably connected to a motor gear contained within the housing, the motor configured to rotate the motor gear about a motor gear axis; and an operator arm operably attached to the housing, the operator arm extending from a first end to a second end, wherein an operator arm axis extends through the first and second ends of the operator arm, wherein the second end of the operator arm is configured for connection to a window sash, and wherein the operator arm is movable between a closed configuration and an open configuration. The operator arm comprises gear teeth arranged along an arcuate path at the first end of the operator arm, wherein the gear teeth mesh with the motor gear. The power window operator further includes a pivot pin slot formed in the operator arm, wherein the pivot pin slot comprises a first end located closer to the first end of the operator arm than the second end of the operator arm and a second end located further away from the first end of the operator arm than the first end of the pivot pin slot; a pivot pin operably attached to the housing, wherein the pivot pin is received in the pivot pin slot of the operator arm. The power window operator also includes a lock operator operably attached to the housing, the lock operator configured for attachment to a sash lock assembly, the lock operator configured to move between a locked position and an unlocked position; a drive rack operably attached to the operator arm; a lock operator rack operably attached to the lock operator; a drive rack gear configured to engage with the drive rack, wherein the drive rack gear is configured to rotate about a drive rack gear axis; and a lock operator gear configured to engage with the lock operator rack, wherein the lock operator gear is configured to rotate about a lock operator gear axis, and wherein rotation of the drive rack gear about the drive rack gear axis causes rotation of the lock operator gear about the lock operator gear axis. When the operator arm is in the closed configuration and the lock operator is in the locked position, the drive rack gear is engaged with the drive rack and rotation of the motor gear in a first direction moves the operator arm along the operator arm axis relative to the housing such that the pivot pin moves within the pivot pin slot toward the first end of the pivot pin slot, wherein the drive rack rotates the drive rack gear about the drive rack gear axis as the pivot pin moves towards the first end of the pivot pin slot, wherein rotation of the drive rack gear by the drive rack rotates the lock operator gear about the lock operator gear axis, wherein rotation of the lock operator gear moves the lock operator rack in a direction aligned with the operator arm axis such that the lock operator moves from the locked position to the unlocked position as the pivot pin moves toward the first end of the pivot pin slot; further rotation of the motor gear in the first direction after the pivot pin reaches the first end of the pivot pin slot rotates the operator arm about the pivot pin at the first end of the pivot pin slot such that the operator arm moves from the closed configuration to the open configuration. Rotation of the motor gear in a second direction when the operator arm is in the open configuration rotates the operator arm about the pivot pin at the first end of the pivot pin slot to move the operator arm from the open configuration to the closed configuration; further rotation of the motor gear in the second direction after moving the operator arm from the open configuration to the closed configuration moves the operator arm along the operator arm axis relative to the housing such that the drive rack moves in a direction aligned with the operator arm axis to engage with and rotate the drive rack gear about the drive rack gear axis, wherein rotation of the drive rack gear rotates the lock operator gear about the lock operator gear axis, wherein rotation of the lock operator gear moves the lock operator into the locked position.

In one or more embodiments of a power window operator according to the first aspect, the drive rack gear axis and the lock operator gear axis are offset from each other in a direction transverse to the drive rack gear axis.

In one or more embodiments of a power window operator according to the first aspect, the drive rack gear and the lock operator gear are attached to each other such that the drive rack gear axis and the lock operator gear axis are colinear with each other.

In one or more embodiments of a power window operator according to the first aspect, when the operator arm is in the closed configuration and the lock operator is in the locked position, the lock operator gear and the lock operator rack move the lock operator out of the locked position before the operator arm moves out of the closed configuration.

In one or more embodiments of a power window operator according to the first aspect, when the operator arm moves from the open configuration to the closed configuration, the lock operator gear and the lock operator rack move the lock operator to the locked position after the operator arm moves into the closed configuration.

In one or more embodiments of a power window operator according to the first aspect, when the operator arm is in the closed configuration and the lock operator is in the locked position, the drive rack gear, the drive rack, the lock operator gear, and the lock operator rack are configured to move the lock operator in a direction aligned with the operator arm axis at a faster rate than the operator arm moves along the operator arm axis as the lock operator moves from the locked position to the unlocked position.

In one or more embodiments of a power window operator according to the first aspect, the drive rack gear and the lock operator gear define a gear ratio, and wherein an (drive rack gear):(lock operator gear) ratio is less than one (1) and, alternatively, 0.8 or less; 0.6 or less, or 0.4 or less.

In one or more embodiments of a power window operator according to the first aspect, when the operator arm is in the closed configuration and the lock operator is in the unlocked position, the drive rack engages with the drive rack gear after the operator arm moves along the operator arm axis such that the pivot pin moves out of the first end and toward the second end of the pivot pin slot in the operator arm as lock operator moves toward the locked position.

In one or more embodiments of a power window operator according to the first aspect, wherein the power window operator comprises a hand crank that is selectively engageable with the motor gear such that, when the hand crank is selectively engaged with the motor gear, operation of the hand crank rotates the motor gear about the motor gear axis, and wherein, when the hand crank is not selectively engaged with the motor gear, rotation of the motor gear about the motor gear axis does not rotate the hand crank. In one or more embodiments, the power window operator comprises a hand crank gear assembly configured to rotate the motor gear about the motor gear axis when the hand crank is rotated about a hand crank axis when the hand crank is selectively engaged with the motor gear. In one or more embodiments, when the hand crank is not engaged with the motor gear, rotation of the motor gear about the motor gear axis does not rotate the hand crank about the hand crank axis.

In one or more embodiments of a power window operator according to the first aspect, wherein rotation of the motor gear in the second direction after moving the operator arm from the open configuration to the closed configuration moves the operator arm along the operator arm axis relative to the housing such that the pivot pin slot moves along the pivot pin until the pivot pin is positioned at the second end of the pivot pin slot when the operator arm is in the closed configuration.

In one or more embodiments of a power window operator according to the first aspect, wherein movement of the lock operator between the locked position and the unlocked position is along a direction aligned with the operator arm axis when the operator arm in the closed configuration and the pivot pin is located at the second end of the pivot pin slot.

In a second aspect, one or more embodiments of a power window operator described herein includes: a housing configured for attachment to a window frame; a motor operably connected to a motor gear contained within the housing, the motor configured to rotate the motor gear about a motor gear axis; and an operator arm operably attached to the housing, the operator arm extending from a first end to a second end, wherein an operator arm axis extends through the first and second ends of the operator arm, wherein the second end of the operator arm is configured for connection to a window sash, and wherein the operator arm is movable between a closed configuration and an open configuration. The operator arm comprises gear teeth arranged along an arcuate path at the first end of the operator arm, wherein the gear teeth mesh with the motor gear; and a pivot pin slot formed in the operator arm, wherein the pivot pin slot comprises a first end located closer to the first end of the operator arm than the second end of the operator arm and a second end located further away from the first end of the operator arm than the first end of the pivot pin slot. The power window operator further includes a pivot pin operably attached to the housing, wherein the pivot pin is received in the pivot pin slot of the operator arm; a lock operator operably attached to the housing, the lock operator configured for attachment to a sash lock assembly, the lock operator configured to move between a locked position and an unlocked position; a drive rack operably attached to the operator arm; a lock operator rack operably attached to the lock operator; a drive rack gear configured to engage with the drive rack, wherein the drive rack gear is configured to rotate about a drive rack gear axis; and a lock operator gear configured to engage with the lock operator rack, wherein the lock operator gear is configured to rotate about a lock operator gear axis, and wherein rotation of the drive rack gear about the drive rack gear axis causes rotation of the lock operator gear about the lock operator gear axis. When the operator arm is in the closed configuration and the lock operator is in the locked position, the drive rack gear is engaged with the drive rack and rotation of the motor gear in a first direction moves the operator arm along the operator arm axis relative to the housing such that the pivot pin moves within the pivot pin slot toward the first end of the pivot pin slot, wherein the drive rack rotates the drive rack gear about the drive rack gear axis as the pivot pin moves towards the first end of the pivot pin slot, wherein rotation of the drive rack gear by the drive rack rotates the lock operator gear about the lock operator gear axis, wherein rotation of the lock operator gear moves the lock operator rack in a direction aligned with the operator arm axis such that the lock operator moves from the locked position to the unlocked position as the pivot pin moves toward the first end of the pivot pin slot; further rotation of the motor gear in the first direction after the pivot pin reaches the first end of the pivot pin slot rotates the operator arm about the pivot pin at the first end of the pivot pin slot such that the operator arm moves from the closed configuration to the open configuration. Rotation of the motor gear in a second direction when the operator arm is in the open configuration rotates the operator arm about the pivot pin at the first end of the pivot pin slot to move the operator arm from the open configuration to the closed configuration; further rotation of the motor gear in the second direction after moving the operator arm from the open configuration to the closed configuration moves the operator arm along the operator arm axis relative to the housing such that the drive rack moves in a direction aligned with the operator arm axis to engage with and rotate the drive rack gear about the drive rack gear axis, wherein rotation of the drive rack gear rotates the lock operator gear about the lock operator gear axis, wherein rotation of the lock operator gear moves the lock operator into the locked position. When the operator arm is in the closed configuration and the lock operator is in the locked position, the lock operator gear and the lock operator rack move the lock operator out of the locked position before the operator arm moves out of the closed configuration. When the operator arm moves from the open configuration to the closed configuration, the lock operator gear and the lock operator rack move the lock operator to the locked position after the operator arm moves into the closed configuration. When the operator arm is in the closed configuration and the lock operator is in the locked position, the drive rack gear, the drive rack, the lock operator gear, and the lock operator rack are configured to move the lock operator in a direction aligned with the operator arm axis at a faster rate than the operator arm moves along the operator arm axis as the lock operator moves from the locked position toward the unlocked position.

In a third aspect, one or more embodiments of a window described herein includes: a window frame having a sash rotatable attached to the window frame, wherein the sash moves between a closed position in the window frame and an open position in the window frame and a power window operator. The power window operator comprises: a housing attached to the window frame; a motor operably connected to a motor gear contained in the housing, the motor configured to rotate the motor gear about a motor gear axis; an operator arm extending from a first end to a second end, wherein an operator arm axis extends through the first and second ends of the operator arm, and wherein the second end of the operator arm is operably attached to the sash, and further wherein the operator arm comprises gear teeth arranged along an arcuate path at the first end of the operator arm, wherein the gear teeth mesh with the motor gear; and a pivot pin slot formed in the operator arm, wherein the pivot pin slot comprises a first end located closer to the first end of the operator arm than the second end of the operator arm and a second end located further away from the first end of the operator arm than the first end of the pivot pin slot. The power window operator further comprises a pivot pin operably attached to the housing, wherein the pivot pin is received in the pivot pin slot of the operator arm; a lock assembly configured to lock the sash in the closed position when the lock assembly is in a locked configuration; a lock operator configured to move along the window frame between a locked position and an unlocked position, and wherein the lock operator is operably attached to the lock assembly such that the lock assembly moves to the locked configuration when the lock operator moves to the locked position and the lock assembly moves to an unlocked configuration when the lock operator moves to the unlocked position; a drive rack operably attached to the operator arm; a lock operator rack operably attached to the lock operator; a drive rack gear configured to engage with the drive rack, wherein the drive rack gear is configured to rotate about a drive rack gear axis; and a lock operator gear configured to engage with the lock operator rack, wherein the lock operator gear is configured to rotate about a lock operator gear axis, and wherein rotation of the drive rack gear about the drive rack gear axis causes rotation of the lock operator gear about the lock operator gear axis. When the sash is in the closed position and the lock operator is in the locked position, the drive rack gear is engaged with the drive rack and rotation of the motor gear in a first direction moves the operator arm along the operator arm axis relative to the housing such that the pivot pin moves within the pivot pin slot toward the first end of the pivot pin slot, wherein the drive rack rotates the drive rack gear about the drive rack gear axis as the pivot pin moves towards the first end of the pivot pin slot, wherein rotation of the drive rack gear by the drive rack rotates the lock operator gear about the lock operator gear axis, wherein rotation of the lock operator gear moves the lock operator rack in a direction aligned with the operator arm axis such that the lock operator moves from the locked position to the unlocked position as the pivot pin moves toward the first end of the pivot pin slot, and wherein movement of the lock operator into the unlocked position moves the lock assembly to the unlocked configuration; further rotation of the motor gear in the first direction after the pivot pin reaches the first end of the pivot pin slot rotates the operator arm about the pivot pin at the first end of the pivot pin slot such that the sash moves from the closed position to the open position. Rotation of the motor gear in a second direction when the sash is in the open position rotates the operator arm about the pivot pin at the first end of the pivot pin slot to move the sash from the open position to the closed position; further rotation of the motor gear in the second direction after moving the sash from the open position to the closed position moves the operator arm along the operator arm axis relative to the housing such that the drive rack moves in a direction aligned with the operator arm axis to engage with and rotate the drive rack gear about the drive rack gear axis, wherein rotation of the drive rack gear rotates the lock operator gear about the lock operator gear axis, wherein rotation of the lock operator gear moves the lock operator into the locked position, and wherein movement of the lock operator into the locked position moves the lock assembly to the locked configuration.

In one or more embodiments of a window according to the third aspect, the drive rack gear axis and the lock operator gear axis are offset from each other in a direction transverse to the drive rack gear axis.

In one or more embodiments of a window according to the third aspect, the drive rack gear and the lock operator gear are attached to each other such that the drive rack gear axis and the lock operator gear axis are colinear with each other.

In one or more embodiments of a window according to the third aspect, when the sash is in the closed position and the lock operator is in the locked position, the lock operator gear and the lock operator rack move the lock operator out of the locked position before the sash moves out of the closed position.

In one or more embodiments of a window according to the third aspect, when the sash moves from the open position to the closed position, the lock operator gear and the lock operator rack move the lock operator to the locked position after the sash moves into the closed position.

In one or more embodiments of a window according to the third aspect, when the sash is in the closed position and the lock operator is in the locked position, the drive rack gear, the drive rack, the lock operator gear, and the lock operator rack are configured to move the lock operator in a direction aligned with the operator arm axis at a faster rate than the operator arm moves along the operator arm axis as the lock operator moves from the locked position to the unlocked position.

In one or more embodiments of a window according to the third aspect, the drive rack gear and the lock operator gear define a gear ratio, and wherein an (drive rack gear):(lock operator gear) ratio is less than one (1) and, alternatively, 0.8 or less; 0.6 or less, or 0.4 or less.

In one or more embodiments of a window according to the third aspect, when the sash is in the closed position and the lock operator is in the unlocked position, the drive rack engages with the drive rack gear after the operator arm moves along the operator arm axis such that the pivot pin moves out of the first end and toward the second end of the pivot pin slot in the operator arm as lock operator moves toward the locked position.

In one or more embodiments of a window according to the third aspect, the power window operator comprises a hand crank that is selectively engageable with the motor gear such that, when the hand crank is selectively engaged with the motor gear, operation of the hand crank rotates the motor gear about the motor gear axis, and wherein, when the hand crank is not selectively engaged with the motor gear, rotation of the motor gear about the motor gear axis does not rotate the hand crank.

In a fourth aspect, one or more embodiments of a method of unlocking an opening or closing and locking a window includes: unlocking a lock before opening a sash of the window when the sash of the window is in a closed configuration; and closing the sash of the window before locking the sash when the sash of the window is in an open configuration; wherein the unlocking, opening, closing, and locking are performed using either: a motor to drive the lock during unlocking and locking and to drive the sash when opening and closing the sash, or a manual operator to drive the lock during unlocking and locking and to drive the sash when opening and closing the sash, wherein using the manual operator does not backdrive the motor.

As used herein and in the appended claims, the singular forms "a," "an," and "the" include plural referents unless the context clearly dictates otherwise. Thus, for example, reference to "a" or "the" component may include one or more of the components and equivalents thereof known to those skilled in the art. Further, the term "and/or" means one or all of the listed elements or a combination of any two or more of the listed elements.

It is noted that the term "comprises" and variations thereof do not have a limiting meaning where these terms appear in the accompanying description. Moreover, "a," "an," "the," "at least one," and "one or more" are used interchangeably herein.

The above summary is not intended to describe each embodiment or every implementation of the power window operators, windows incorporating the same, and methods of using the same as described herein. Rather, a more complete understanding of the invention will become apparent and appreciated by reference to the following Description of Illustrative Embodiments and claims in view of the accompanying figures of the drawing.

BRIEF DESCRIPTION OF THE VIEWS OF THE DRAWING

FIG. 8B depicts an enlarged portion of FIG. 8A) with the operator arm in a closed configuration and the lock operator in a locked position as described herein.

DESCRIPTION OF ILLUSTRATIVE EMBODIMENTS

Figure 1:
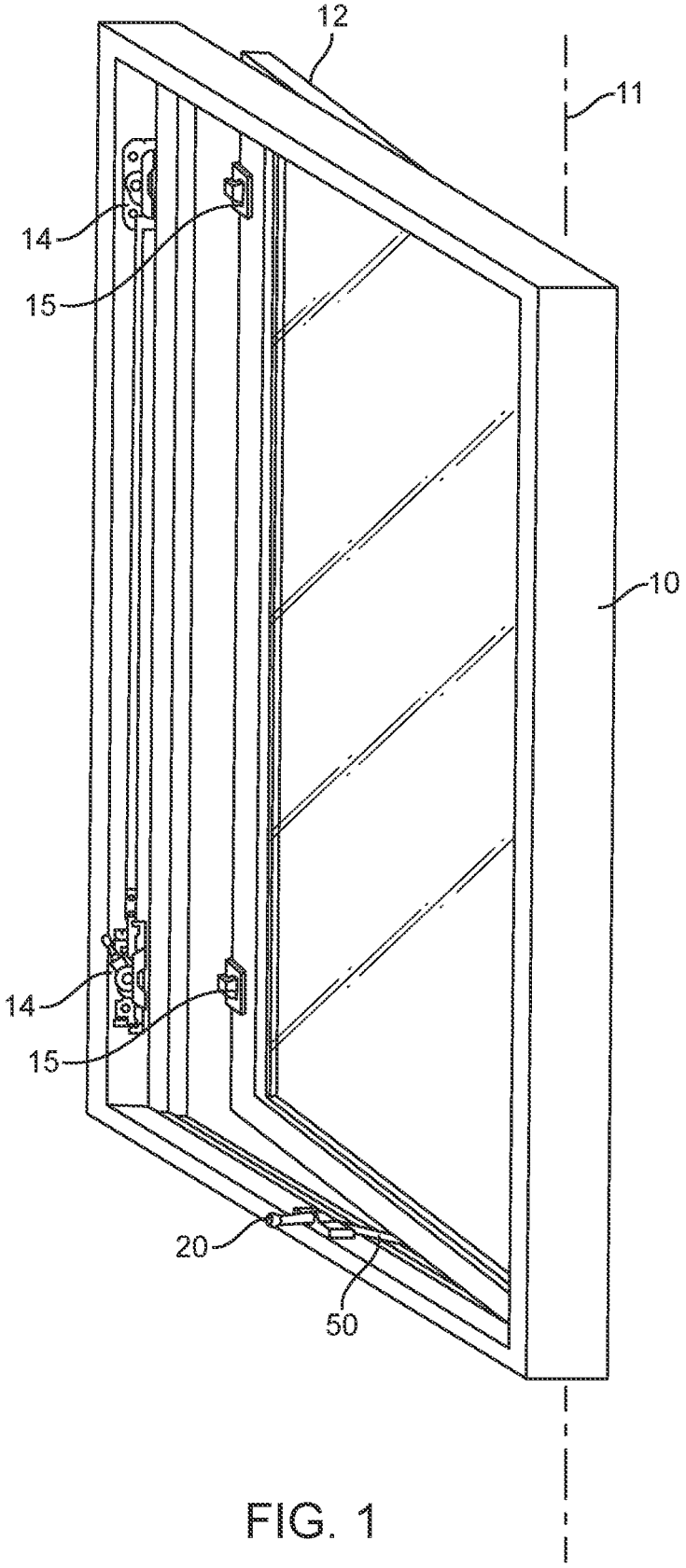
FIG. 1 is a perspective view of one illustrative embodiment of a hinged window incorporating one illustrative embodiment of a power window operator as described herein installed on a window.

In the following description of illustrative embodiments, reference is made to the accompanying figures of the drawing which form a part hereof, and in which are shown, by way of illustration, specific embodiments. It is to be understood that other embodiments may be utilized and structural changes may be made without departing from the scope of the present invention.

The power window operators described herein may be used with a variety of different windows where the windows include a movable sash in a window frame, with the movable sash attached to the window frame such that the movable sash is rotated to open or close the window. Some examples of windows with which the power window operators described herein may be used include casement windows, awning windows, French casement windows, hopper windows, tilt-turn windows, pivot windows, utility windows, skylights, roof windows, etc.

One illustrative embodiment of a window with which the power window operators described herein may be used is depicted in FIG. 1 and includes a movable sash 12 and a window frame 10, with the movable sash 12 being mounted for rotation about an axis, e.g., axis 11 to open and close the window. The window may include one or more sash lock assemblies including lock mechanisms 14 mounted on the frame 10 and associated keepers 15 mounted on the movable sash 12. The lock mechanisms 14 and keepers 15 of the lock assemblies may be used to retain the movable sash 12 in a closed position. The depicted window also includes one illustrative embodiment of a power window operator 20 including an operator arm 50, with the operator arm 50 being movable between a closed configuration and an open configuration to rotate the movable sash 12 about axis 11 to open and close the window. In one or more embodiments, the axis 11 (and the movable sash 12) may move laterally as the movable sash 12 rotates about the axis 11 depending on the linkages used to connect the movable sash 12 to the frame 10 (as is known in, e.g., conventional casement windows, etc.).

The power window operators described herein may, in one or more embodiments, rotation of the operator arm rotates the movable sash between its open and closed positions. The operator arm may, in one or more embodiments, be rotated manually or with the use of a motor (e.g., an electric motor, hydraulic motor, etc.). In one or more embodiments where motorized operation is selected, a hand crank or other manual operation structure used to manually rotate the operator arm may be disengaged or otherwise disabled. In one or more embodiments in which manual operation is desired, the motor may be disengaged from the operator arm such that manual operation does not require back-driving of the motor (which could increase the force required to open or close the movable sash).

Figure 2:
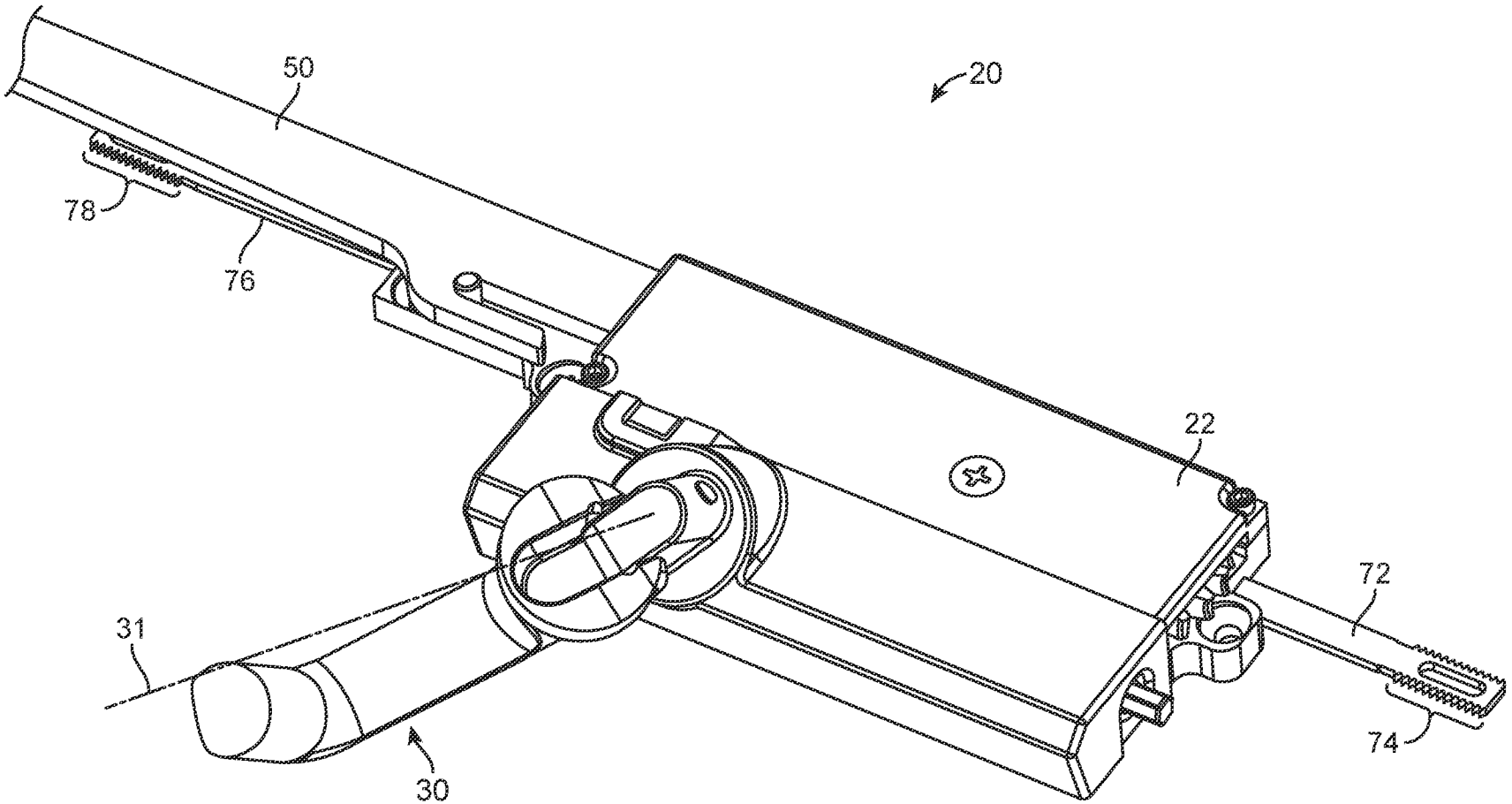
FIG. 2 is a top perspective view depicting one illustrative embodiment of a power window operator with the operator arm in a closed configuration and the lock operator in a locked position as described herein.

A top perspective view of one illustrative embodiment of a portion of a power window operator 20 that may be used in a window as described herein is depicted in FIG. 2. The depicted power window operator 20 includes a housing cover 22, an operator arm 50 extending out of the housing cover 22, and a pair of lock operators 72 and 76 also extending out of the housing cover 22. The power window operator 20 also includes a handle 30 rotating about a manual operation axis 31. The handle 30 may, as described herein, be manually rotated about axis 31 during manual operation of the power window operator 20 to open and close a sash connected to the power window operator 20.

In many respects, the operator arm 50 may rotate outwardly and inwardly to open and close a sash connected to the operator arm in a manner generally similar to known operator arms in sash operating mechanisms, some examples of which are described in U.S. Pat. No. 10,119, 318; International Publication WO 2015/140667; etc.

Although the depicted power window operator 20 includes a pair of lock operators 72 and 76, one or more alternative embodiments of power window operators as described herein may include only one lock operator, e.g., either lock operator 72 or lock operator 76. Lock operator 72 includes a junction 74 at its distal end, while lock operator 76 includes a junction 78 at its distal end. The junctions 74 and 78 are configured for attachment to one or more sash lock assemblies of a window on or in which the power window operator 20 is installed (see, e.g., lock mechanisms 14 in the window depicted in FIG. 1). In the depicted illustrative embodiment, each of junctions 74 and 78 includes a slot and serrated edges which may be configured to operably connect with a tie bar, tape drive, etc. that extends between the junctions 74 and 78 and a connected sash lock assembly. Examples of such components and their operation may be described in, e.g., U.S. Pat. Nos. 10,119, 318; 7,452,014; U.S. Patent Publication No. 2012/0146342; and U.S. Patent Publication No. 2016/0130847.

Each lock operator 72 and 76 is configured for movement between a locked position and an unlocked position. Movement of a lock operator between its locked and unlocked positions moves a sash lock operably connected to the lock operator between its locked and unlocked configurations. When such a sash lock is in a locked configuration and the lock operator operably attached to that sash lock is in its locked position, a sash operably connected to the power window operator is locked when in its closed position in the window, thereby preventing opening of the sash. When a sash lock is in an unlocked configuration and the lock operator operably attached to that sash lock is in its unlocked position, a sash operably connected to the power window operator is unlocked.

Figure 3A:
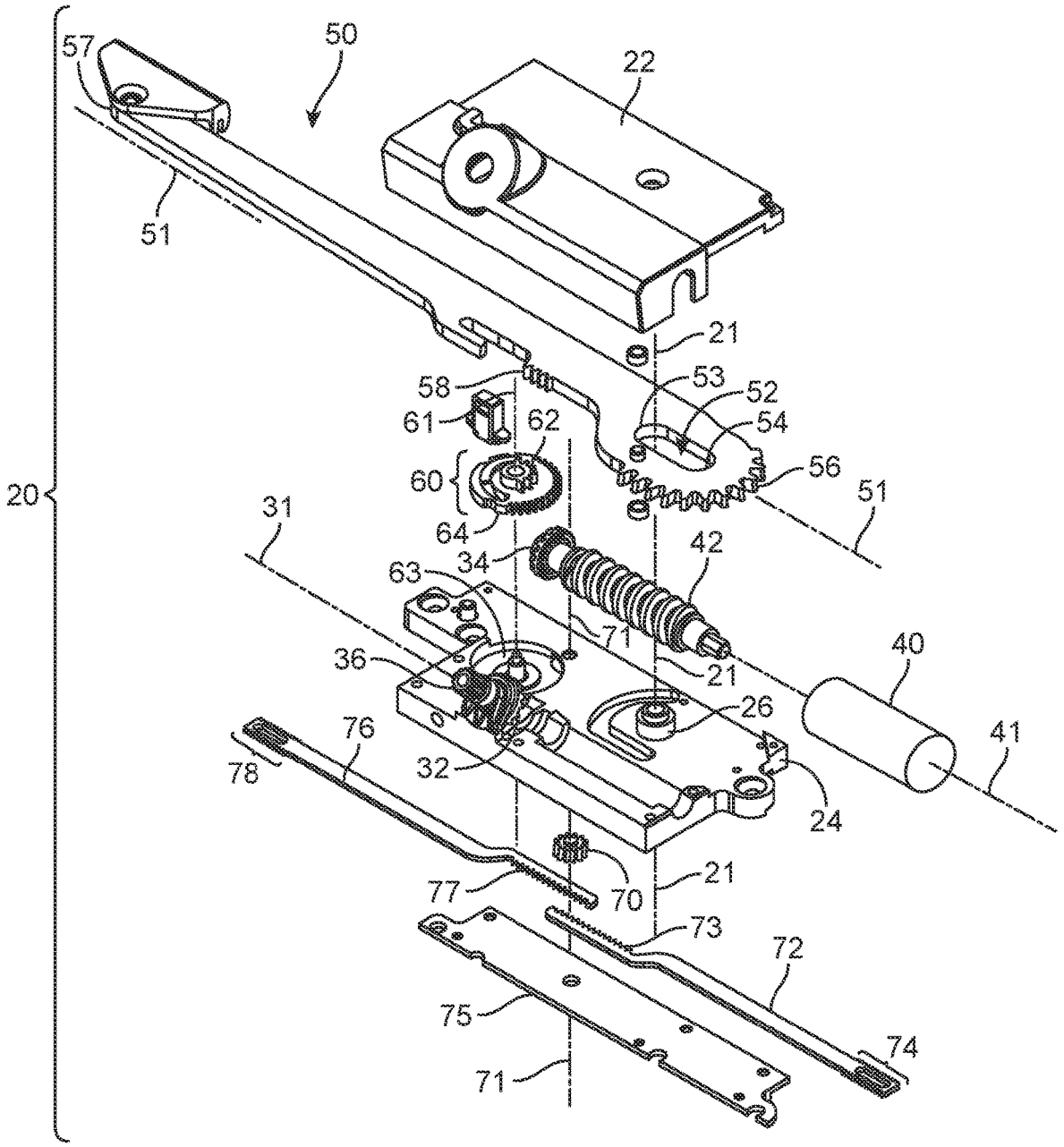
FIG. 3A is an exploded diagram of the power window operator depicted in FIG. 2.
Figure 3B:
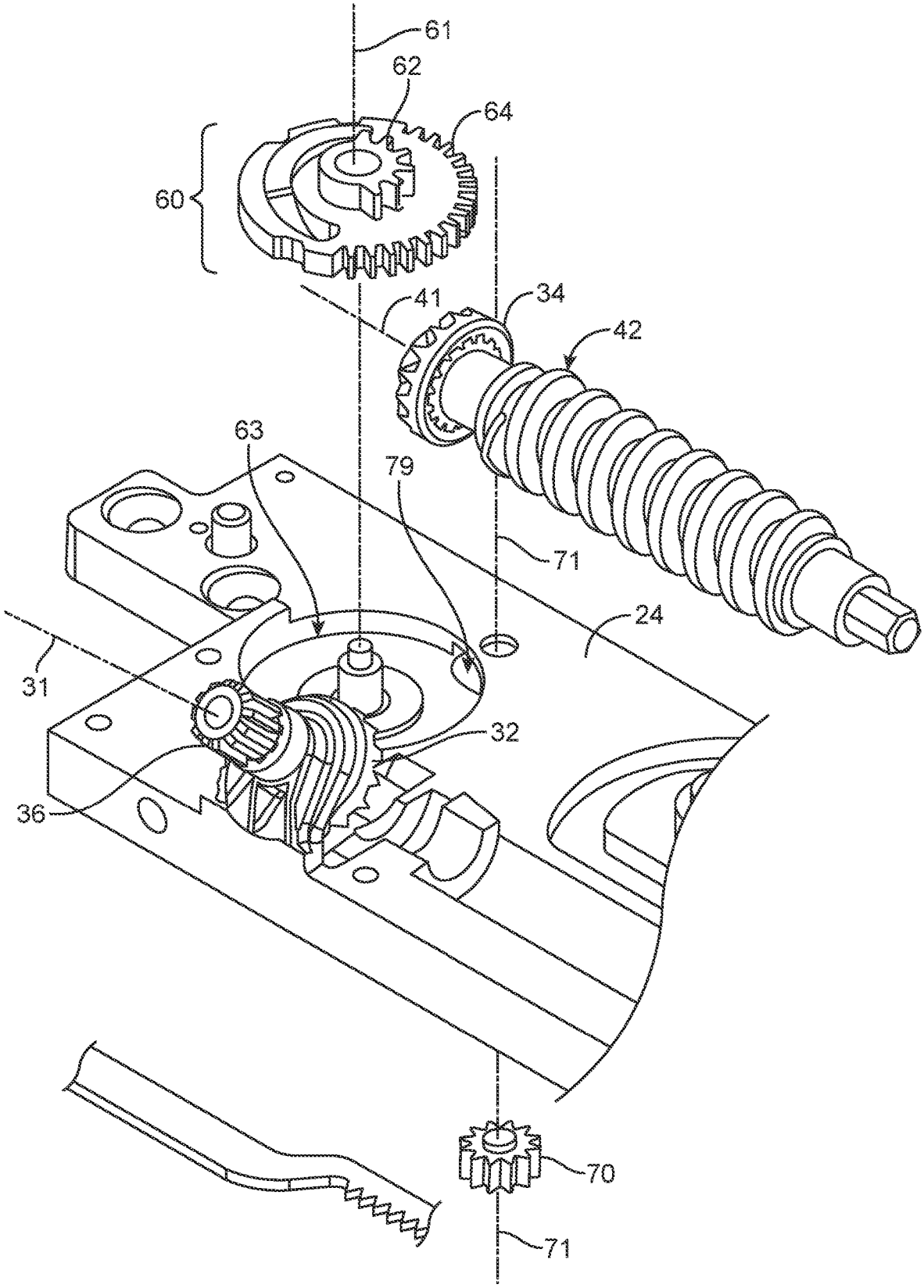
FIG. 3B is an enlarged portion of the exploded diagram of FIG. 3A.
Figure 3C:
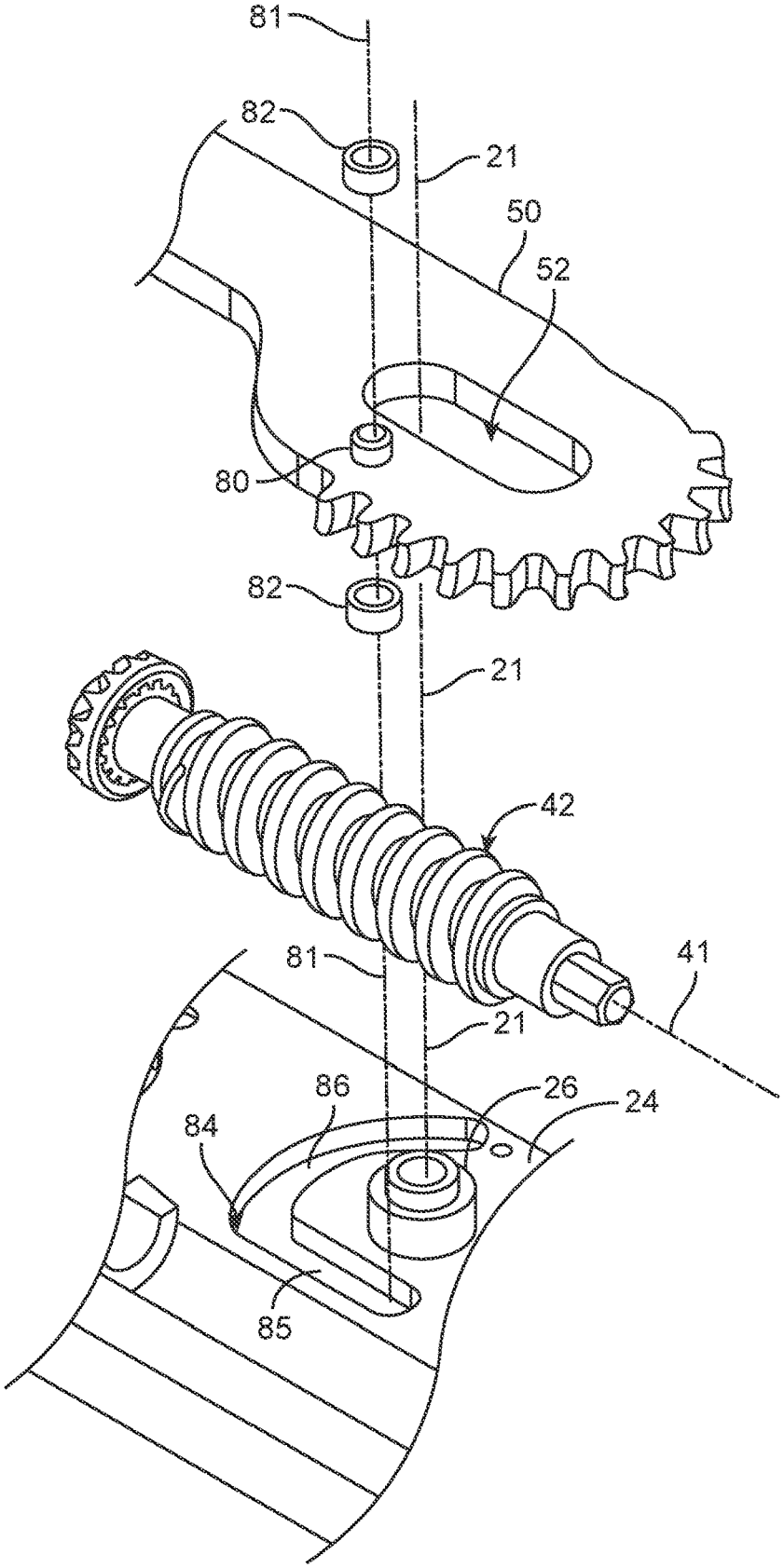
FIG. 3C is another enlarged portion of the exploded diagram of FIG. 3A.

The illustrative embodiment of power window operator 20 is depicted in an exploded assembly diagram in FIG. 3A, with selected portions of the exploded diagram of FIG. 3A being provided in FIGS. 3B and 3C. As depicted in FIG. 3A, the power window operator 20 includes a housing having a cover 22 and a base 24 to which the cover is attached when the power window operator is fully assembled.

In the depicted embodiment, the power window operator 20 includes components used to allow for manual operation of the operator arm 50 such that the operator arm can be moved between its closed configuration and open configuration to, correspondingly, close an open a sash attached to the operator arm 50. The power window operator 20 also includes components required for motorized operation of the operator arm 50 such that the operator arm 50 can be moved between its closed and open configurations.

Among the components of the power window operator 20 used to move operator arm 50 between its open and closed configurations are a motor gear/worm 42 operably attached to a motor 40. As motor gear/worm 42 rotates about a motor gear axis 41 when driven by the motor 40, the motor gear/worm 42 engages complementary teeth 56 on the operator arm 50 to rotate operator arm 50 about pivot pin axis 21 after translating operator arm 50 along operator arm axis 51 as described herein. Motor gear/worm 42 is also operably attached to the handle 30 (see, e.g., FIG. 2) through a pair of bevel gears 32 and 34, with bevel gear 32 being operably connected to a splined connector 36 configured to mate with the handle 30 such that as handle 30 is rotated about axis 31, bevel gear 32 also rotates about axis 31.

In one or more embodiments, the handle 30 may be selectively coupled with the motor gear/worm 42 to move operator arm 50 between its open and close configurations. A variety of different selective coupling mechanisms capable of performing the functions of selectively coupling the handle 30 with motor gear/worm 42 may be described in, e.g., U.S. patent application Ser. No. 15/624,860, filed Jun. 16, 2017 and titled DRIVE SYSTEMS AND HINGED WINDOW ASSEMBLIES INCORPORATING THE SAME. Those selective coupling mechanisms may include one or more of, e.g., a magnetic clutch, electric clutch, mechanical clutch, fluid clutch, pinned joint, other type of mechanical release, etc. In systems that use one or more such selective coupling mechanisms, rotation of the motor gear/worm 42 about motor gear axis 41 using the motor 40 may not cause corresponding rotation of bevel gear 34 and such that rotation of the motor gear/worm gear 42 using handle 30 (i.e., by rotating handle 30 about handle axis 31) can be performed without requiring back driving of motor 40 because motor 40 is decoupled from the motor gear/worm 42 during manual operation using handle 30.

Other selective coupling mechanisms may provide for selective engagement of the handle 30 with the splined member 36 such that the handle 30 is decoupled from bevel gears 32 and 34. Decoupling handle 30 from the splined member 36 may allow for rotation of splined member 36 about handle axis 31 as bevel gear 34 rotates about motor gear axis 41 and causes corresponding rotation of bevel gear 32 about handle axis 31. In such an embodiment, handle 30 may or may not be decoupled from motor 40 during manual operation of handle 32 open and close a sash connected to the power window operator 20.

As discussed herein, operator arm 50 is used to open and close a sash operably connected to the power window operator described herein. Although the depicted illustrative embodiment of power window operator 20 includes only one operator arm, it will be understood that alternative embodiments may include two or more operator arms with appropriate modifications to the remainder of the power window operator. Operator arm 50 extends between the power window operator when mounted on a window frame and the sash to be moved using the operator arm 50. Operator arm 50 includes a first end 56 having gear teeth arranged along an arcuate path at the first end 56 of the operator arm 50. The gear teeth at the first end 56 are configured to mesh with the motor gear/worm 42 (or any other gear being driven by a motor of the power window operators described herein). Operator arm 50 extends from the first end 56 to a second end 57, with the second end 57 being configured for connection to a window sash using any suitable mechanism or combination of mechanisms.

Operator arm 50 further includes a pivot pin slot 52 formed in the operator arm 50. The pivot pin slot 52 has a first end 54 located closer to the first end 56 of the operator arm 50 than the second and 57 of the operator arm 50. Pivot pin slot 52 also includes a second end 53 located further away from the first and 56 of the operator arm 50 than the first end 54 of the pivot pin slot 52. When assembled between the housing cover 22 and the housing base 24, pivot pin 26 is located within pivot pin slot 52 of the operator arm 52 guide/control movement of the operator arm 50 as described herein.

With reference to FIG. 3C, the depicted illustrative embodiment of operator arm 50 also includes a guide pin assembly including guide pin 80 and bushings 82 fitted on to guide pin 80. Guide pin 80 and bushings 82 move within guide pin slot 84 in housing base 24. In the depicted illustrative embodiment, housing cover 22 also includes a guide pin slot in which the upper bushing 82 is located when the housing cover 22 is assembled on the base 24. Guide pin slot 84 and the guide pin assembly cooperate to assist in guiding movement of the operator arm 50 during movement of the operator arm 50 between its open and closed configurations.

While the components discussed thus far are used to move the operator arm 50 between its open and closed configurations (and, therefore, also move a sash operably connected to the operator arm 50 between its open and closed positions), other components of the power window operators described herein are used to control locking and unlocking of any sash lock assemblies operably connected to the power window operators described herein.

In the depicted illustrative embodiment, those components include a pair of lock operators 72 and 76, each of which includes a junction 74 and 78, respectively, such that the lock operators are configured for attachment to a sash lock assembly as described herein. Also depicted in FIG. 3A is a retention plate 75 attached to the bottom of the housing base 24 to retain components on the bottom of the housing base 24 in position relative to the housing base 24. For example, retention plate 75 may be particularly useful in retaining lock operators 72 and 76 in position relative to lock operator gear 70 for proper operation of the power window operators described herein.

Further, the lock operators 72 and 76 are configured for movement between a locked position and an unlocked position. For example, in one or more embodiments the lock operators 72 and 76 may extend or move outwardly (in opposite directions) from the housing base 24 when moving from their locked positions to their unlocked positions, while movement of the lock operators 72 and 76 towards or inwardly (in opposite directions) relative to the housing base 24 constitutes movement of the lock operators 72 and 76 from locked positions to unlocked positions. In one or more alternative embodiments, the lock operators 72 and 76 may move in opposite directions from that described directly above when moving between their respective locked and unlocked positions. Further, in still other alternative embodiments including two lock operators 72 and 76, the lock operators may move in the same direction rather than opposite directions when moving between their respective locked and unlocked positions.

Movement of the lock operators 72 and 76 between their locked and unlocked positions is accomplished using lock operator racks 73 and 77 on each of the lock operators 72 and 76 and a lock operator gear 70 configured to engage with the lock operator racks 73 and 77. The lock operator gear 70 is configured to rotate about a lock operator gear axis 71. As the lock operator gear 70 rotates about that axis, lock operator gear 70 engages the lock operator racks 73 and 77 to move the lock operators 72 and 76 between their locked and unlocked positions. In other words, rotation of lock operator gear 70 about axis 71 in one direction moves the lock operators 72 and 76 to their unlocked positions, while rotation of the lock operator gear 70 in the opposite direction moves the lock operators 72 and 76 to their unlocked positions.

The illustrative embodiment of a power window operator as depicted in FIG. 3A also includes a drive rack gear 60 configured to engage with a drive rack 58 on operator arm 50. As operator arm 50 is moved along operator arm axis 51 as motor gear/worm 42 engages teeth at the first end 56 of the operator arm 50, drive rack gear 60 is rotated about drive rack gear axis 61 by drive rack 58 on operator arm 50. In particular, the depicted embodiment of drive rack gear 60 is a compound gear including upper gear 62 and lower gear 64, with both upper gear 62 and lower gear 64 rotating about drive rack gear axis 61. Rotation of the upper gear 62 of drive rack gear 60 about drive rack gear axis 61 by drive rack 58 causes corresponding rotation of lower gear 64 about driver gear axis 61. Lower gear 64 engages lock operator gear 70, such that rotation of lower gear 64 (i.e., drive rack gear 60) causes lock operator gear 70 to rotate about lock operator gear axis 71. In this depicted illustrative embodiment, the drive rack gear axis 61 about which drive rack gear 60 rotates and the lock operator gear axis 71 about which lock operator gear 70 rotates are offset from each other in a direction transverse to the drive rack gear axis 61 (and, in the depicted embodiment, also transverse to the lock operator gear axis 71).

With reference to FIG. 3B, lower gear 64 of drive rack gear 60 is positioned in recess 63 of housing base 24 with an aperture 79 being provided to allow lower gear 64 to engage and upper portion of lock operator gear 70 such that rotation of lower gear 64 of drive rack gear 60 causes corresponding rotation of lock operator gear 70, with the lower portion of lock operator gear 70 driving lock operators 72 and 76 as described herein.

Figure 4A:
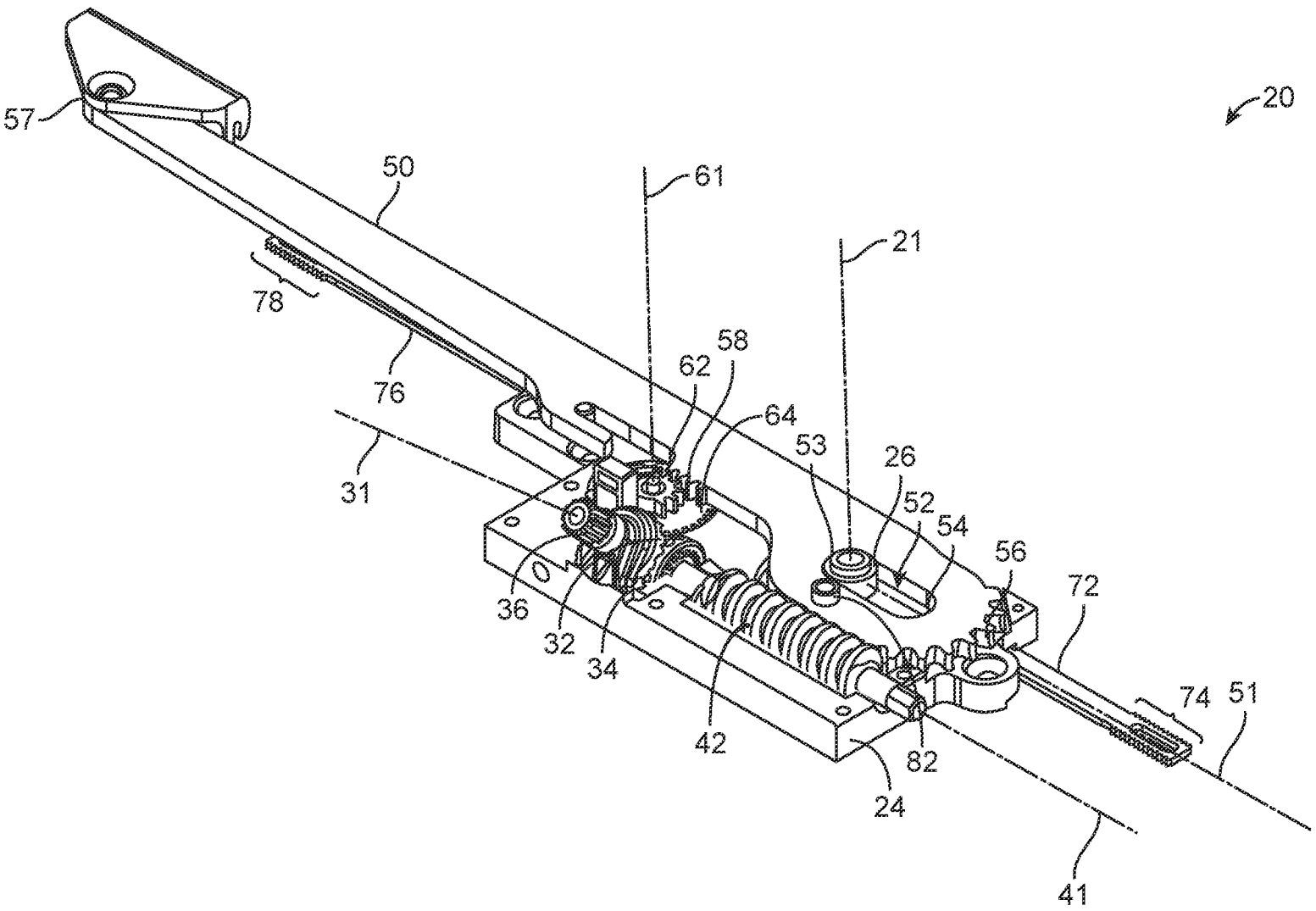
FIG. 4A is a top perspective view of the power window operator of FIG. 2 with the housing cover removed to expose various components as assembled within the power window operator.
Figure 5:
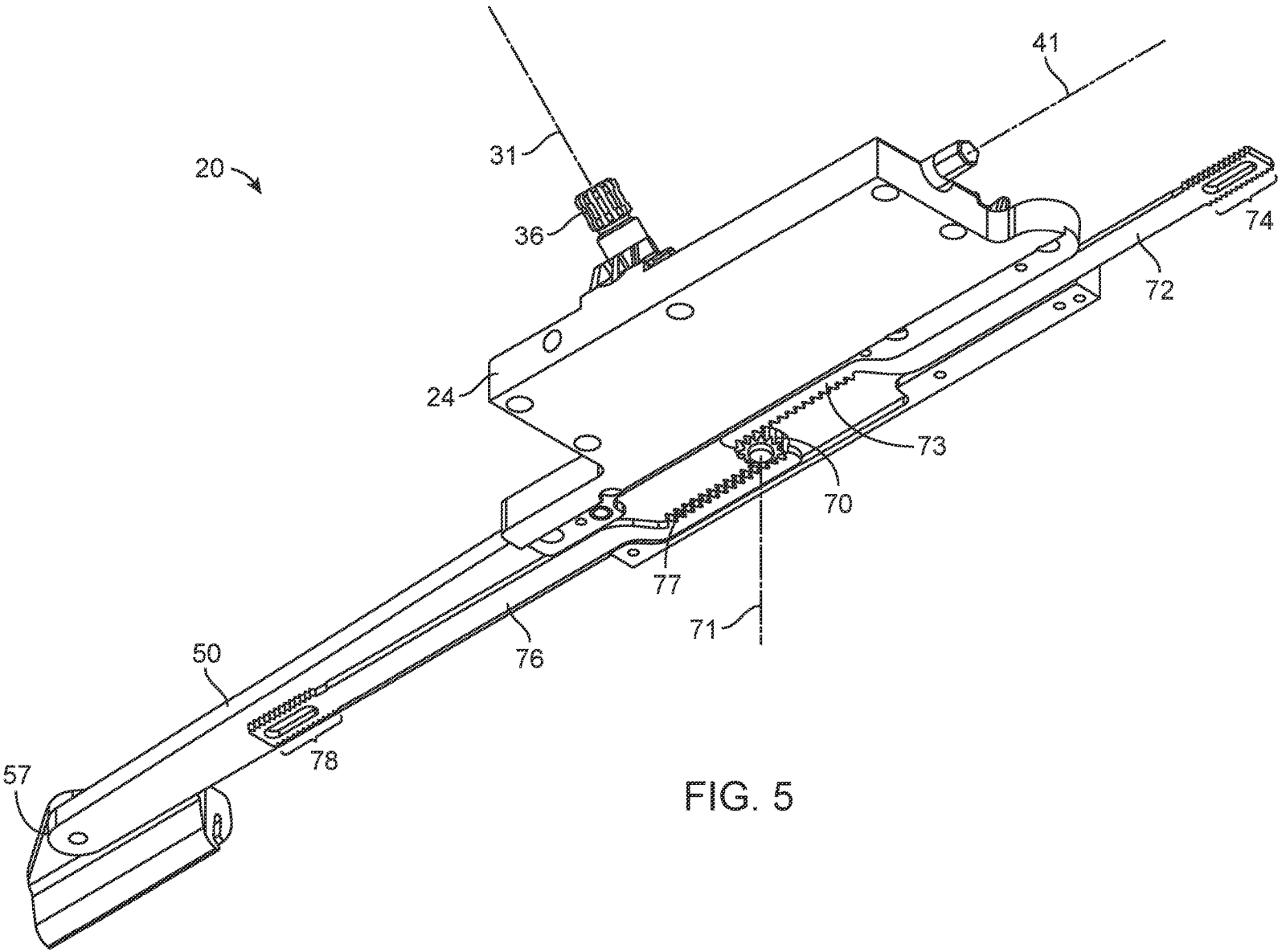
FIG. 5 is a bottom perspective view of the power window operator of FIG. 4A.

The components of the illustrative embodiment of power window operator 20 as depicted in the exploded diagram of FIG. 3A are shown as assembled on the housing base 24 in FIGS. 4A and 5 in which the operator arm 50 may be described as being in its closed position, while lock operators 72 and 76 are in their locked positions. As depicted, motor gear/worm 42 is engaged with the teeth at the first end 56 of the operator arm 50. Pivot pin 26 is located at the second end 53 of pivot pin slot 52 in operator arm 50.

Bevel gears 32 and 34 are engaged with each other such that rotation of spindle 36 about handle axis 31 can, in one or more embodiments, rotate bevel gear 32 which may, in turn, rotate bevel gear 34. In those systems in which bevel gear 34 is selectively coupled with motor gear/worm 42, rotation of bevel gear 34 about motor gear axis 41 can cause corresponding rotation of motor gear/worm 42 two move operator arm 50 between its locked and unlocked positions as described herein.

Further, upper gear 62 of drive rack gear 60 is engaged with drive rack 58 on operator arm 50. Although not depicted in FIGS. 4A/4B, lower gear 64 is engaged with lock operator gear 70 on the bottom of housing base 24. Further, lock operator gear 70 is engaged with lock operator racks 73 and 77 on lock operators 72 and 76 (retention plate 75 has been removed in the view of FIG. 5 to allow for visualization of the interface between lock operator gear 70 and lock operators 72 and 76).

With reference to FIG. 4A, upper gear 62 of drive rack gear 60 is engaged with the drive rack 58 and rotation of the motor gear/worm 42 (also referred to herein as motor gear) about motor gear axis 41 in one direction moves the operator arm 50 along the operator arm axis 51 relative to the housing base 24. That movement of operator arm 50 along operator arm axis 51 causes pivot pin 26 to move within the pivot pin slot 52 towards the first end 54 of pivot pin slot 52 as seen in, e.g., FIG. 4B.

Figure 4B:
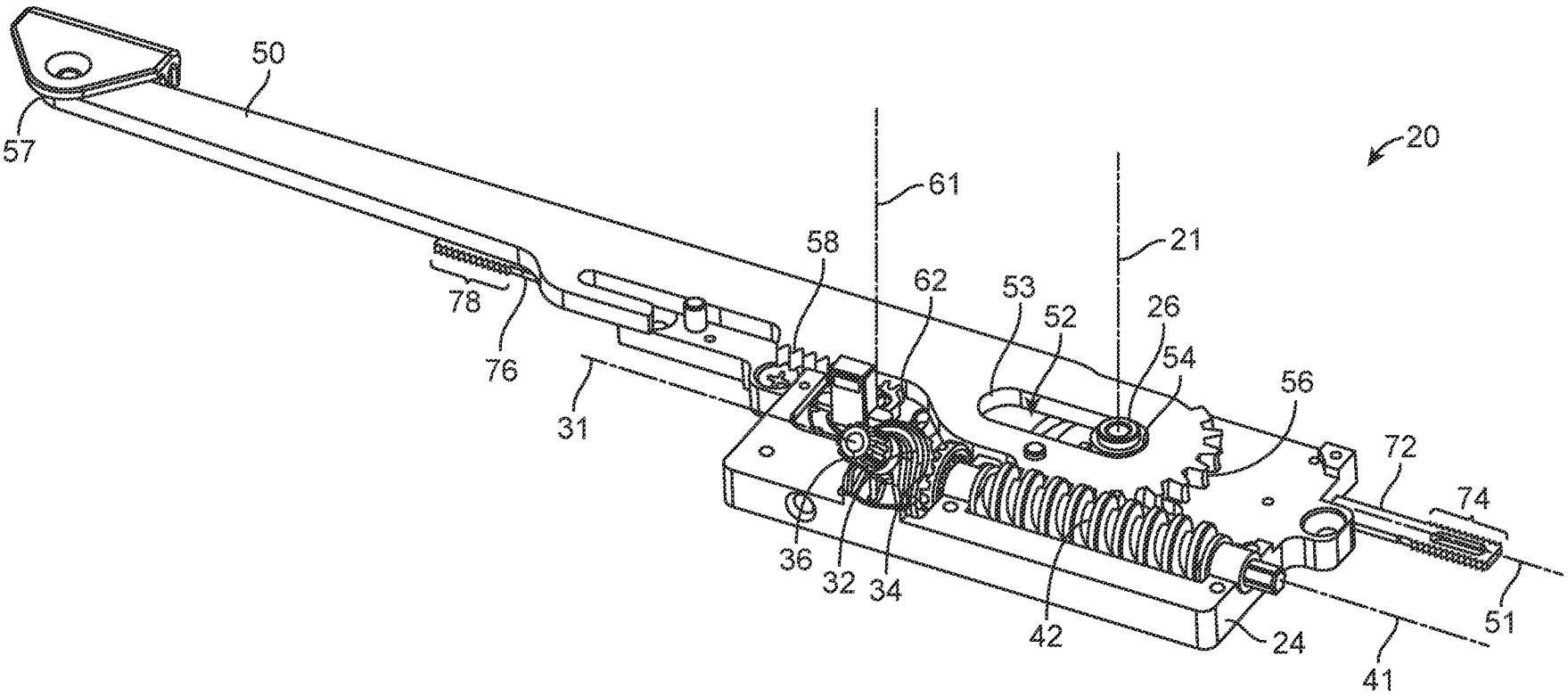
FIG. 4B is a view of FIG. 4A with the operator arm translated to the left such that the pivot pin is located at the first end of the pivot pin slot.

During that movement of the operator arm 50 (as seen by the change in position of operator arm 50 relative to pivot pin 26 in FIGS. 4A and 4B), drive rack 58 on operator arm 50 rotates upper gear 62 and lower gear 64 of the drive rack gear 60 about the drive rack gear axis 61 as the pivot pin 26 moves towards the first end 54 of pivot pin slot 52. Rotation of the lower gear 64 of the drive rack gear 60 by the drive rack 58 on operator arm 50 rotates the lock operator gear 70 about the lock operator gear axis 71. That rotation of lock operator gear 70 moves the lock operator racks 73 and 77 in directions aligned with the operator arm axis 51, such that the lock operators 72 and 76 move from their locked positions to their unlocked positions as the pivot pin 26 moves towards the first end 54 of the pivot pin slot 52.

Figure 6:
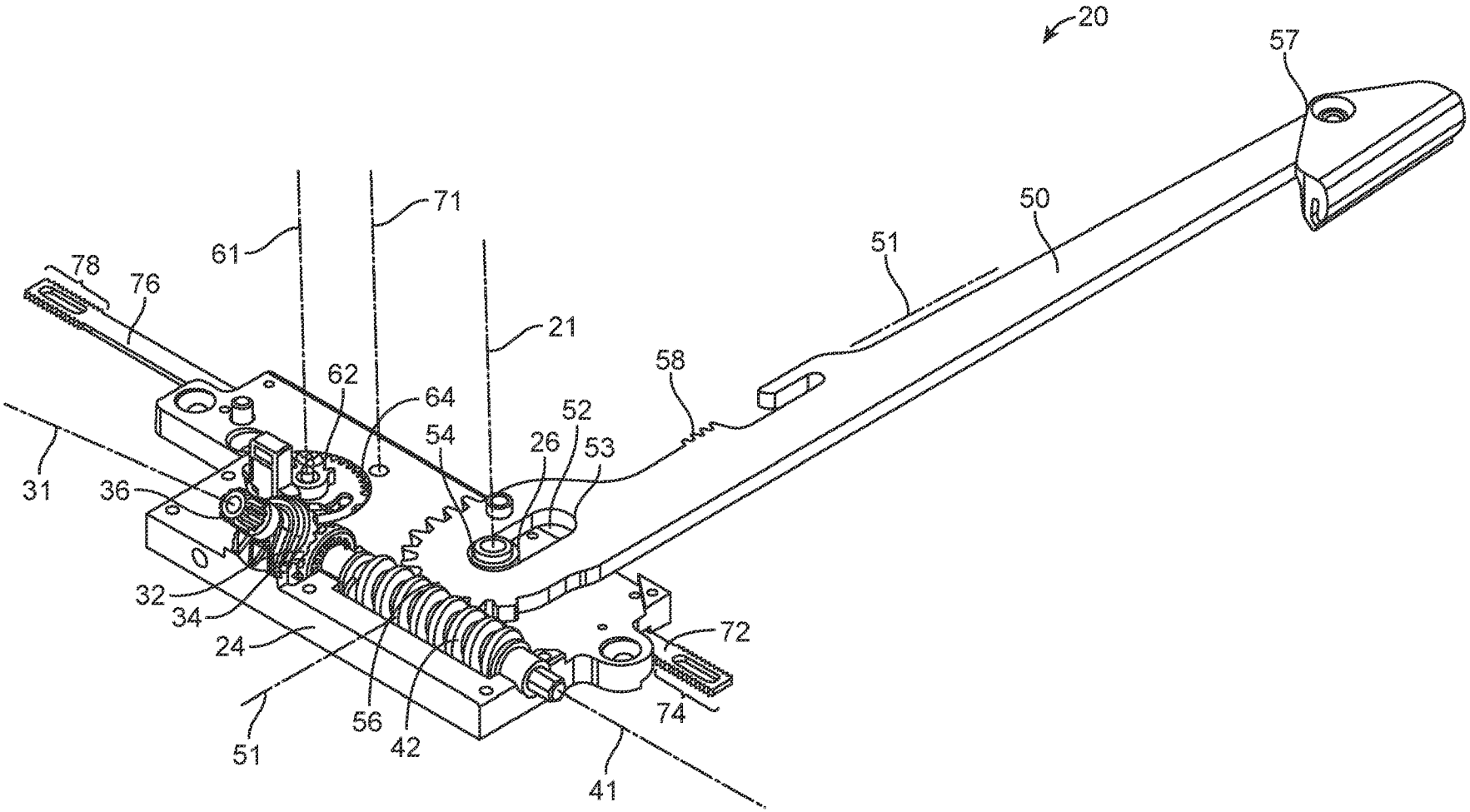
FIG. 6 is a top perspective view of the power window operator of FIG. 2 with the housing cover removed, the operator arm in an open configuration and the lock operator in an unlocked position as described herein.
Figure 7:
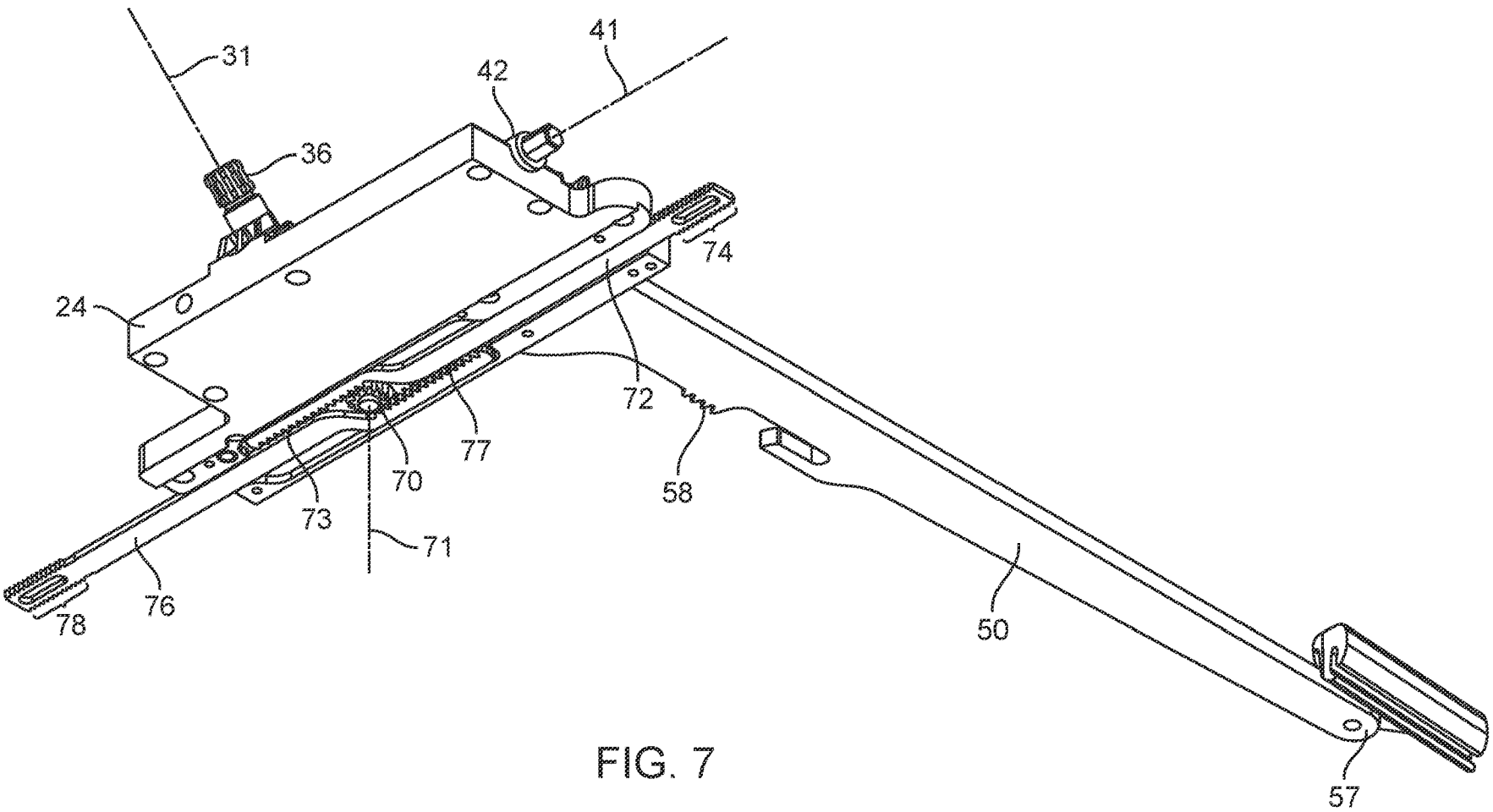
FIG. 7 is a bottom perspective view of the power window operator of FIG. 6.

Further rotation of the motor gear/worm 42 about motor gear axis 41 in the first direction after the pivot pin 26 reaches the first end 54 of the pivot pin slot 52 (see FIG. 4B where the pivot pin 26 is located at the first end 54 of the pivot pin slot 26) causes the operator arm 50 to rotate about the pivot pin 26 (and the corresponding pivot pin axis 21) at the first end 54 of the pivot pin slot such that the operator arm 50 rotates about pivot pin axis 21 such that the operator arm 50 moves from its closed configuration as seen in, e.g., FIGS. 4A/4B and 5 to an open configuration as seen in, e.g., FIGS. 6 and 7.

As seen in, e.g., FIG. 6, in the depicted illustrative embodiment of power window operator 20, operator arm 50 is rotated relative to pivot pin axis 21, with pivot pin 26 being located at the first end 54 of pivot pin slot 52. Further, with reference to FIG. 7, lock operators 72 and 76 have been drawn into housing base 24 through rotation of lock operator gear 70 about lock operator gear axis 71. As depicted in FIGS. 6 and 7, lock operators 72 and 76 may be described as being in their unlocked positions as a result of movement of the operator arm from its closed position to its open position.

While operator arm 50 is depicted as moving from its closed position in FIGS. 4A/B and 5 to its open position in FIGS. 6-7 and lock operators 72 and 76 being depicted as moving from their locked positions in FIGS. 4A and 5 to their unlocked positions in FIGS. 6-7 due to rotation of the motor gear/worm 42 in a first direction about motor gear axis 41, rotation of the motor gear/worm 42 in a second, opposite direction about motor gear axis 41 when the operator arm 50 is in its open configuration as depicted in FIGS. 6-7 causes operator arm 50 to rotate about the pivot pin 26 and pivot pin axis 21 at the first end 54 of the pivot pin slot 52. That rotation of operator arm 50 moves the operator arm 50 from its open configuration as seen in FIG. 6-7 to its closed configuration as seen in FIGS. 4A/4B-5. In that rotation of operator arm 50 from the open configuration to the closed configuration, pivot pin 26 remains at the first end 54 of the pivot pin slot 52.

After, however, operator arm 50 is rotated around pivot pin 26 back into its closed configuration as seen in FIG. 4B through rotation of the motor gear/worm 42 about motor gear axis 41 in the second direction, operator arm 50 moves along the operator arm axis 51 relative to the housing base 24 and pivot pin 26 such that the pivot pin 26 moves away from first end 54 (see FIG. 4B) and towards second end 53 of pivot pin slot 52 (see FIG. 4A). In one or more embodiments, rotation of the motor gear/worm 42 in the second direction after moving the operator arm 50 from its open configuration (see, e.g., FIGS. 6-7) to its closed configuration (see, e.g., FIGS. 4B and 5) moves the operator arm 50 along the operator arm axis 51 relative to the housing base 24 such that the pivot pin slot 52 moves along the pivot pin 26 until the pivot pin 26 is positioned at the second end 53 of the pivot pin slot 52 when the operator arm 50 is in its closed configuration.

Movement of the operator arm 50 along operator arm axis 51 as the pivot pin 26 moves through pivot pin slot 52 causes the drive rack 58 on operator arm 50 to engage with and rotate the upper gear 62 of drive rack gear 60 about the drive rack gear axis 61. Rotation of upper gear 62 of drive rack gear 60 also causes lower gear 64 to rotate about drive rack gear axis 61. Because lower gear 64 is engaged with lock operator gear 70, rotation of lower gear 64 about its drive rack gear axis 61 causes the lock operator gear 70 to rotate about its lock operator gear axis 71. That rotation of lock operator gear 70 moves the lock operators 72 and 76 from their unlocked positions to their unlocked positions.

In one or more embodiments of power window operators as described herein such as, e.g., power window operator 20, movement of the lock operators 72 and 76 between their respective locked and unlocked positions occurs along a direction aligned with the operator arm axis 51 when the operator arm 50 is in its closed configuration and the pivot pin 26 moves between the first end 54 and the second end 53 of the pivot pin slot 52 as seen in, e.g., FIGS. 4A and 4B.

As discussed herein, the power window operators described herein offer the ability to control the timing and/or speed of the lock/unlock actions relative to the opening/closing of a sash being driven by the power window operators. In connection with the illustrative embodiment of one such power window operator 20 as depicted in FIGS. 3A-7, that control over the locking and unlocking of sash lock assemblies operably connected to the lock operators 72 and 76 is provided by the drive rack 58 on operator arm 50 along with drive rack gear 60 and its interaction with lock operator gear 70 during movement of the operator arm 50.

In particular, when the operator arm 50 is in the closed configuration and the lock operators 72 and 76 are in their respective locked positions as seen in, e.g., FIGS. 4A and 5 the lock operator gear 70 and lock operator racks 73 and 77 on lock operators 72 and 76 move the lock operators 72 and 76 out of their respective locked positions before the operator arm 50 starts to rotate out of its closed configuration. Drive rack 58 rotates drive gear 60 about drive gear axis 61 as operator arm 50 begins to move in translation along operator arm axis 51 such that the pivot pin 26 moves away from the second end 53 and towards the first end 54 of the pivot pin slot 52 (i.e., towards the position seen in FIG. 4B). Moving the lock operators 72 and 76 out of their respective locked positions before rotating operator arm 50 out of its closed configuration prevents restriction of opening of the sash by the operator arm 50 that would occur if the lock operator 72 and 76 did not move out of their respective locked positions before the operator arm 50 rotates out of its closed configuration.

When moving in the opposite direction, i.e., when the operator arm 50 is in its open configuration and the lock operators 72 and 76 are in their respective unlocked positions as seen in, e.g., FIGS. 6-7, the lock operator gear 70 and lock operator racks 73 and 77 on lock operators 72 and 76 move the lock operators 72 and 76 into their respective locked positions after the operator arm 50 completes its rotation into the closed configuration. In particular, drive rack 58 on operator arm 50 rotates drive gear 60 about drive gear axis 61 only after operator arm 50 completes its rotation about pivot pin axis 21 and is moving in translation along operator arm axis 51 as the pivot pin 26 moves out of the first end 54 of pivot pin slot 52 and towards the second end 53 of pivot pin slot 52 (i.e., moves from the position depicted in FIG. 4B to the position depicted in FIG. 4A). Moving the lock operators 72 and 76 into their respective locked positions after rotating operator arm 50 into its closed configuration prevents premature locking of any sash lock assemblies which could, in one or more embodiments, hinder proper closing and securing of the sash of a window connected to the power window operators described herein.

In one or more embodiments of power window operators described herein in which the, when the operator arm 50 is in its closed configuration and the lock operators 72 and 76 are in their respective locked positions (see, e.g., FIG. 4A), the drive rack gear 60, drive rack 58 on operator arm 50, lock operator gear 70 and lock operator racks 73 and 77 are configured to move the lock operators 72 and 76 at a faster rate than the operator arm 50 moves relative to the pivot pin 26 along the operator arm axis as the lock operators 72 and 76 move from their locked positions to their unlocked positions.

In one or more embodiments, the drive rack gear and the lock operator gear may be described as defining a gear ratio of the drive rack gear to the lock operator gear (drive rack gear:lock operator gear) that is less than one and, alternatively, 0.8 or less; 0.6 or less; or 0.4 or less. Where the drive rack gear is a compound gear such as the drive rack gear 60 which includes both upper gear 62 and lower gear 64, the gear ratio "drive rack gear:lock operator gear" is determined based on the gear engaged with the drive rack on the operator arm, e.g., the upper gear 62 of compound drive rack gear 60 in the depicted illustrative embodiment of power window operator 20.

Another optional feature that may be found in one or more embodiments of power window operators as described herein is depicted in connection with the illustrative embodiment of power window operator 20 in which, when the operator arm 50 is in its closed configuration (see, e.g., FIGS. 4A and 5) and the lock operators 72 and 76 are in their respective unlocked positions, the drive rack 58 on operator arm 50 engages with the upper gear 62 of drive rack gear 60 after the operator arm 50 moves along the operator arm axis 51 such that the pivot pin 26 moves out of the first end 54 of pivot pin slot 52 and toward the second end 53 of the pivot pin slot 52 in the operator arm 50 as the lock operators 72 and 76 move towards their respective locked positions (see FIGS. 4A/4B where the operator arm 50 moves along operator arm axis 51 such that pivot pin slot 52 moves relative to pivot pin 26).

One illustrative embodiment of a power window operator as described herein is depicted in connection with FIGS. 3A-7. Some components of one alternative embodiment of a power window operator as described herein is depicted in FIGS. 8A-10. In the FIGS. provided to illustrate this alternative embodiment of a power window operator as described herein, any components necessary for manual operation of the power window operator are not included such as, e.g., a handle or any mechanisms used to transmit movement of that handle to the components needed to move a connected sash between its open and closed positions and/or lock/unlock any associated sash lock assemblies.

Among the components that are, however, depicted in FIGS. 8A-10, are a housing base 124 on which the components of this alternative embodiment of a power window operator as described herein are located. Some of the components may be similar, if not identical, to components used in the illustrative embodiment of power window operator 20 depicted in FIGS. 3A-7.

In particular, drive gear/worm 142 which rotates about a drive gear axis 141 may be the same as the motor gear/worm 42 used in connection with power window operator 20. Although not depicted in connection with this illustrative embodiment, motor gear/worm 142 may also be driven manually using a hand crank and one or more gears such as, e.g., hand crank 30 and bevel gears 32/34 as described above in connection with power window operator 20. Furthermore, although not depicted, motor gear/worm 142 may also be driven by a motor operably connected to rotate motor gear/worm 142 about motor gear axis 141.

Operator arm 150 depicted in connection with this illustrative embodiment of a power window operator may also be the same as the operator arm 50 used in connection with power window operator 20. For example, operator arm 150 includes a first end 156 including gear teeth configured to engage with motor gear/worm 142 and a second end 157 configured for connection to a sash to be opened and closed using operator arm 150.

This depicted illustrative embodiment of operator arm 150 also includes a pivot pin slot 152 having a first end 154 and a second end 153. Pivot pin 126 is attached to the housing base 124 and is also positioned in pivot pin slot 152 when the operator arm 150 is assembled on the housing base 124.

Operation of the illustrative embodiment of the power window operator depicted in FIGS. 8A-10 is, in many respects, similar to operation of the operator arm 50 of power window operator 20 depicted in FIGS. 3A-7. For example, rotation of the drive gear/worm 142 in a first direction causes operator arm 152 move to the left in FIGS. 8A and 8B such that pivot pin slot 152 moves relative to pivot pin 126. In particular, pivot pin slot 152 moves such that pivot pin 126 approaches the first end 154 of pivot pin slot 152. After pivot pin 126 reaches first end 154 of pivot pin slot 152 (see, e.g., FIGS. 9A-9B in which pivot pin 126 is located at first end 154 of pivot pin slot 152).

Figure 10:
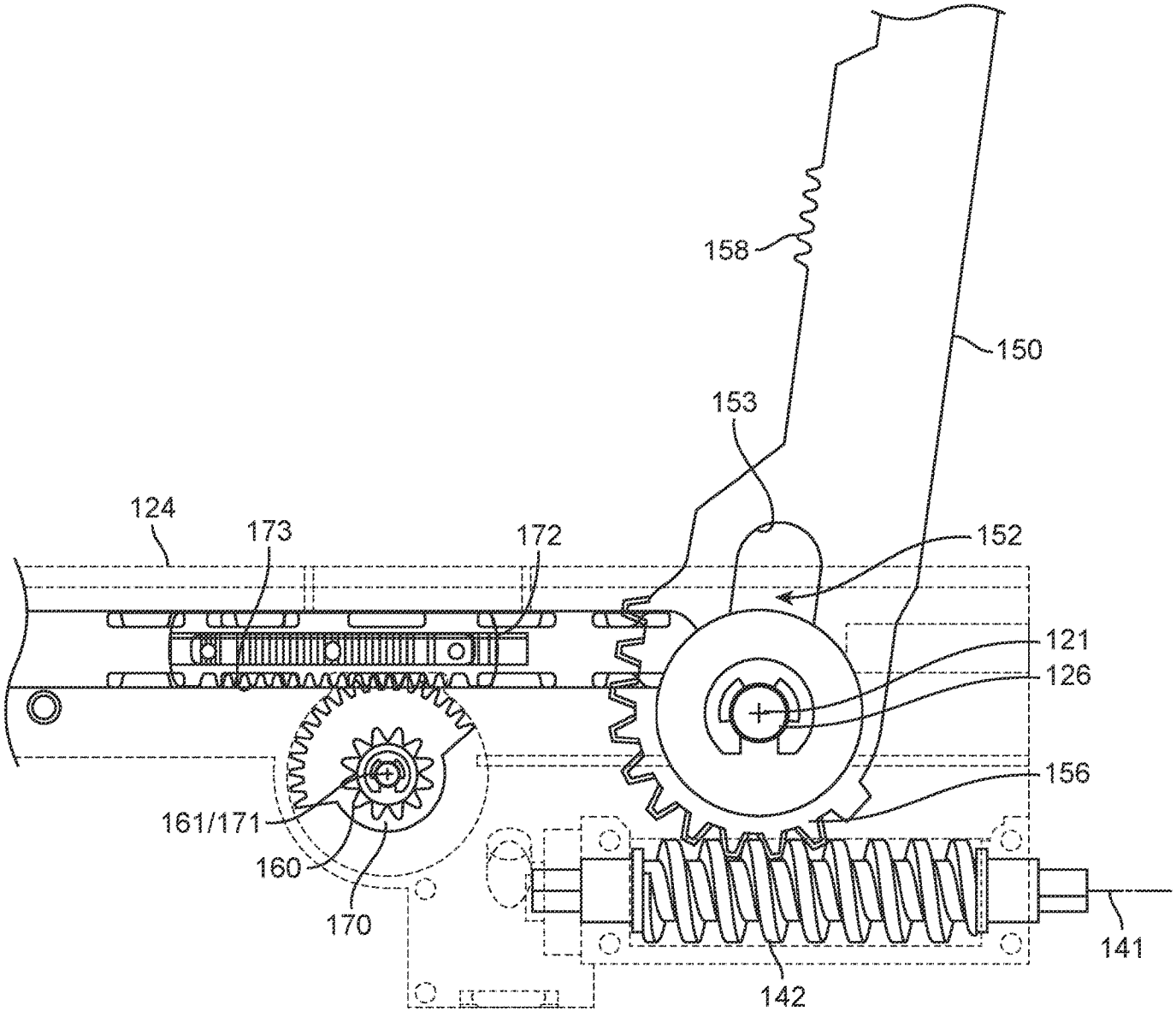
FIG. 10 is an enlarged view of the power window operator of FIG. 8A with the operator arm in an open configuration and the lock operator in an unlocked position as described herein.

Further rotation of drive gear/worm 142 after pivot pin 126 reaches the first end 154 of pivot pin slot 152 causes the operator arm 150 to rotate about pivot pin axis 121 as the remainder of the teeth at first end 156 of operator arm 150 engage rotating drive gear/worm 142. Rotation of operator arm 150 about pivot pin axis 121 causes operator arm 152 move from its closed configuration as seen in FIGS. 8A-9B to its open configuration as seen in FIG. 10.

Among the differences between the power window operator embodiment depicted in FIGS. 8A-10 and power window operator 20 described above in connection with FIGS. 3A-7 are differences in the mechanisms used to move the lock operator between its locked and unlocked positions. A drive rack 158 is provided on operator arm 150 similar to the drive rack 58 provided on operator arm 50 of power window operator 20 described herein. The depicted power window operator also includes a drive rack gear 160 configured to engage with the drive rack 158, with the drive rack gear 160 rotating about a drive rack gear axis 161 extending through a center of the drive rack gear 160.

Similar to power window operator 20 described herein, movement of operator arm 150 along operator arm axis 151 in response to rotation of the drive gear/worm 142 causes drive rack 158 on operator arm 150 to rotate drive rack gear 160 about drive rack gear axis 161 in a manner similar to rotation of upper gear 62 of drive rack gear 60 in response to movement of drive rack 58 on operator arm 50.

The power window operator depicted in FIGS. 8A-10 includes a lock operator gear 170 and a lock operator rack 173 attached to the lock operator 172. Lock operator gear 170 engages lock operator rack 173 to move lock operator 172 between its locked and unlocked positions as lock operator gear 170 rotates about lock operator gear axis 171.

One difference between the assembly used to move the lock operator 172 between its locked and unlocked positions is that the lock operator gear 170 of the power window operator depicted in FIGS. 8A-10 is aligned with drive rack gear 160 and rotates about a lock operator gear axis 171 that is coincident with the drive rack gear axis 161 rather than being offset from the drive rack gear axis.

As discussed herein, rotation of lock operator gear 170 about lock operator gear axis 171 moves the lock operator 172 between its locked and unlocked positions, with the lock operator 172 moving in a direction generally aligned with the operator arm axis 151 during movement of the operator arm 150 along the operator arm axis 151.

The embodiment of power window operator depicted in FIGS. 8A-10 also offers the ability to control the timing and/or speed of the lock/unlock actions relative to the opening/closing of a sash being driven by the power window operator. In connection with the illustrative embodiment of the power window operator depicted in FIGS. 8A-10, that control over the locking and unlocking of a sash lock assembly operably connected to the lock operator 172 is provided by the drive rack 158 on operator arm 150 along with drive rack gear 160 and its interaction with lock operator gear 170 during movement of the operator arm 150.

Figure 8A:
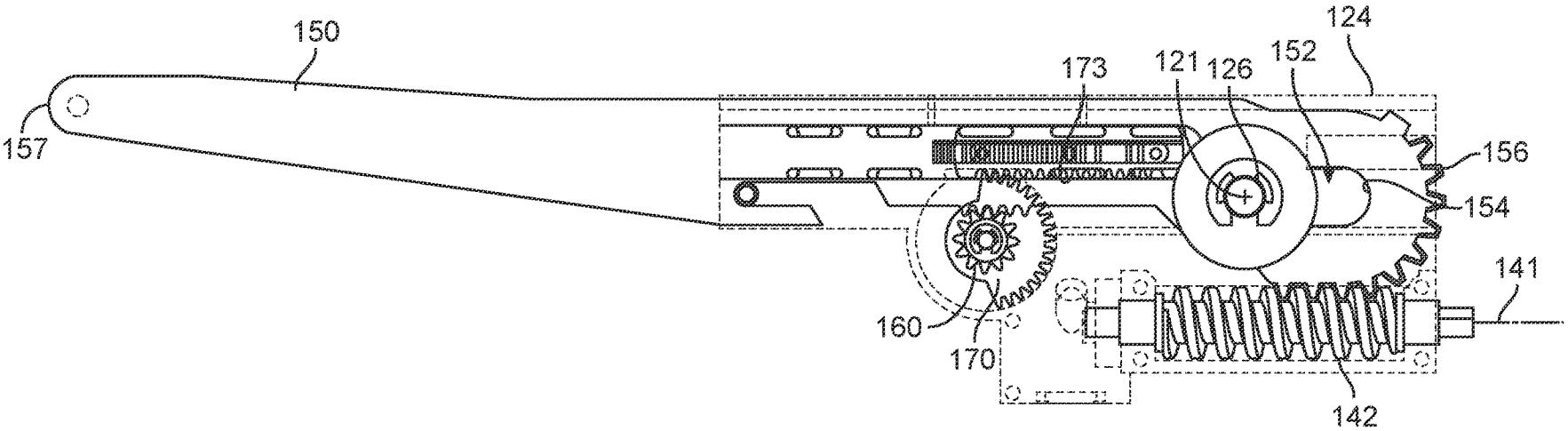
FIGS. 8A and 8B depict a portion of one alternative illustrative embodiment of a power window operator (where
Figure 8B:
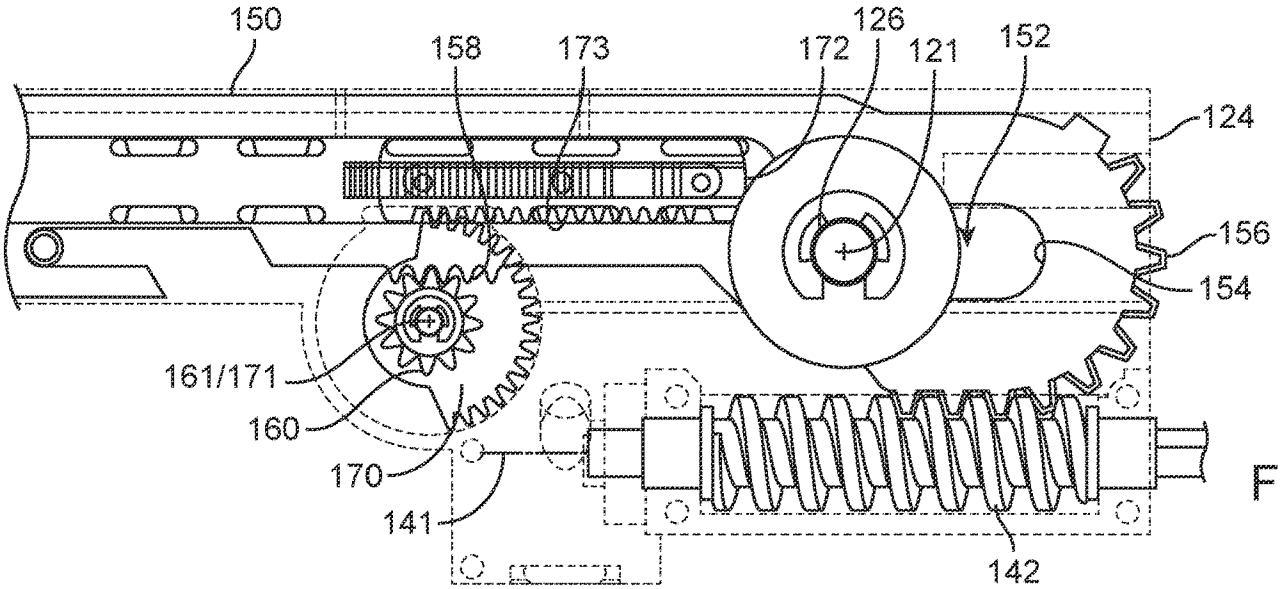
Figure 9A:
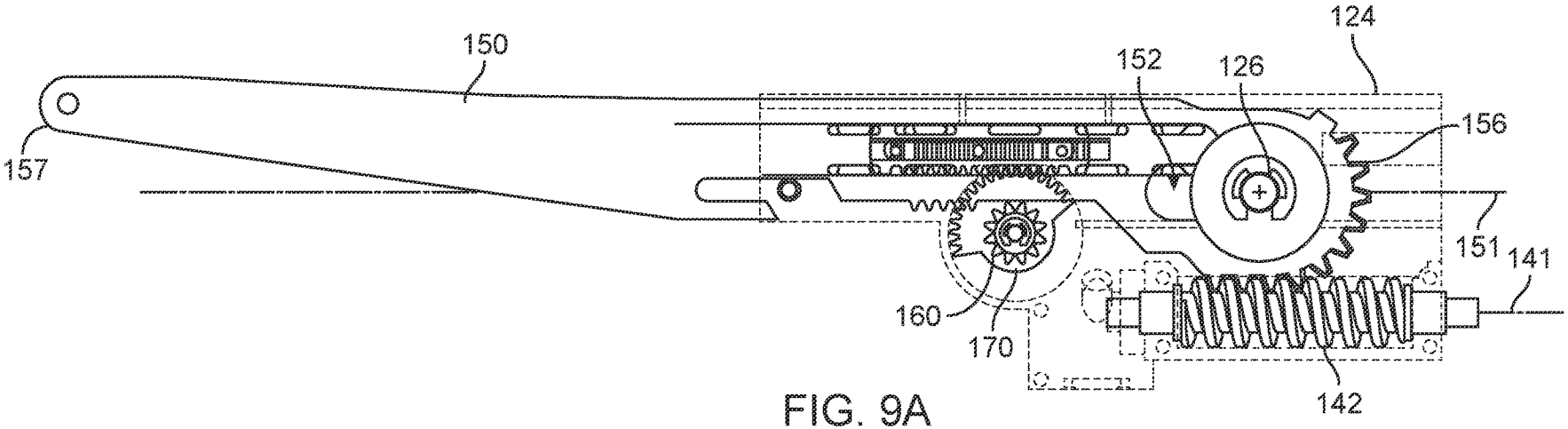
FIGS. 9A and 9B depict the power window operator of FIG. 8A with the operator arm in a closed configuration and the lock operator in an unlocked position as described herein.
Figure 9B:
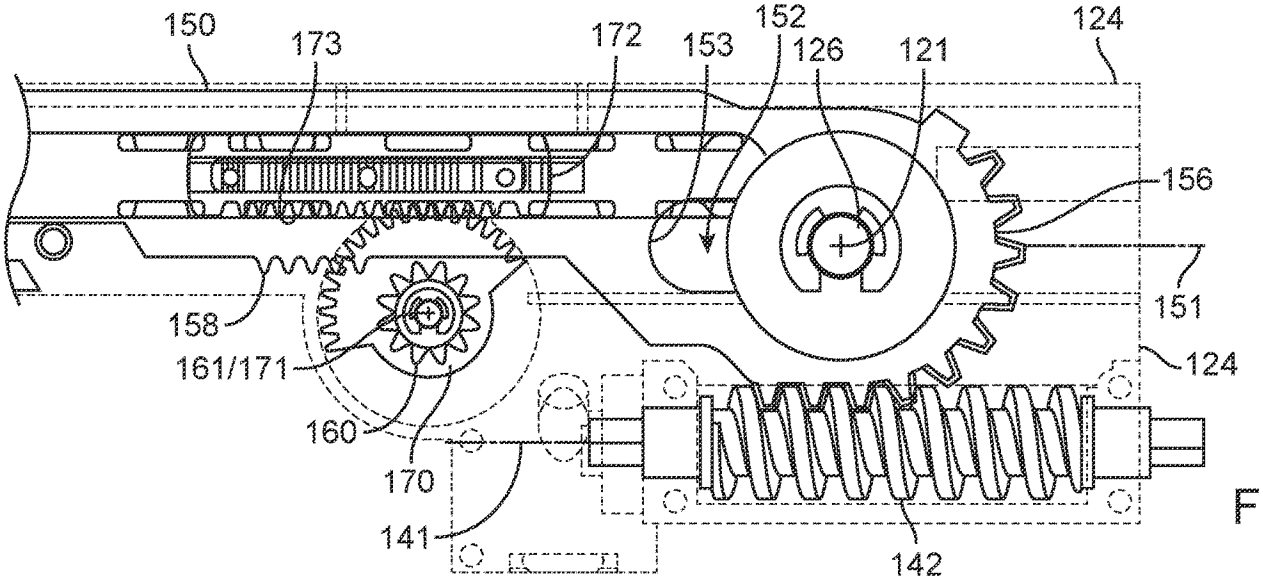

In particular, when the operator arm 150 is in the closed configuration and the lock operator 172 is in its locked position as seen in, e.g., FIGS. 8A-8B, the lock operator gear 170 and lock operator rack 173 on lock operator 172 move the lock operator 172 out of its locked position before the operator arm 150 starts to rotate out of its closed configuration (as seen in FIGS. 8A-8B). Drive rack 158 on operator arm 150 rotates drive rack gear 160 about drive rack gear axis 161 as operator arm 150 begins to move in translation along operator arm axis 151 when the pivot pin 126 is located at the second end 153 of the pivot pin slot 152. Moving the lock operator 172 out of its locked position before rotating operator arm 150 out of its closed configuration prevents restriction of opening of the sash by the operator arm 150 that would occur if the lock operator 172 did not move out of its locked position before the operator arm 150 rotates out of its closed configuration.

When moving in the opposite direction, i.e., when the operator arm 150 is in its open configuration and the lock operator 172 is in its unlocked position as seen in, e.g., FIG. 10, the lock operator gear 170 and lock operator rack 173 on lock operator 172 moves the lock operator 172 into its locked position after the operator arm 150 completes its rotation into the closed configuration. In particular, drive rack 158 rotates drive gear 160 about drive gear axis 161 only after operator arm 150 completes its rotation about pivot pin axis 121 and is moving in translation along operator arm axis 151 as the pivot pin 126 moves out of the first end 154 of pivot pin slot 152 and towards the second end 153 of pivot pin slot 152. Moving the lock operator 172 into its locked position after rotating operator arm 150 into its closed configuration prevents premature locking of any sash lock assemblies operably attached to the lock operator 172 which could, in one or more embodiments, hinder proper closing and securing of the sash of a window connected to the power window operators described herein.

In the illustrative embodiment of power window operator depicted in FIGS. 8A-10, when the operator arm 150 is in its closed configuration and the lock operator 172 is in its locked position, the drive rack gear 160, drive rack 158 on operator arm 150, lock operator gear 170 and lock operator rack 173 are configured to move the lock operator 172 at a faster rate than the operator arm 150 moves relative to the pivot pin 126 along the operator arm axis 151 as the lock operator 172 moves from its locked position to its unlocked position.

In the illustrative embodiment of power window operator depicted in FIGS. 8A-10, the drive rack gear and the lock operator gear may be described as defining a gear ratio of the drive rack gear to the lock operator gear (drive rack gear: lock operator gear) that is less than one and, alternatively, 0.8 or less; 0.6 or less; or 0.4 or less.

Another optional feature found in the illustrative embodiment of power window operator depicted in FIGS. 8A-10, when the operator arm 150 is in its closed configuration and the lock operator 172 is in its unlocked position (see, e.g., FIGS. 9A-9B), the drive rack 158 on operator arm 150 engages with the drive rack gear 160 after the operator arm 150 has moved along the operator arm axis 151 such that the pivot pin 126 is no longer at the first end 154 of pivot pin slot 152.

The complete disclosure of the patents, patent documents, and publications identified herein are incorporated by reference in their entirety as if each were individually incorporated. To the extent there is a conflict or discrepancy between this document and the disclosure in any such incorporated document, this document will control.

Illustrative embodiments of power window operators, windows incorporating the power window operators, and methods of using the power window operators are discussed herein with some possible variations described. These and other variations and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof. It should also be understood that this invention also may be suitably practiced in the absence of any element not specifically disclosed as necessary herein.

What is claimed is:

1. A power window operator comprising:

a housing configured for attachment to a window frame;

a motor operably connected to a motor gear contained within the housing, the motor configured to rotate the motor gear about a motor gear axis;

an operator arm operably attached to the housing, the operator arm extending from a first end to a second end, wherein an operator arm axis extends through the first and second ends of the operator arm, wherein the second end of the operator arm is configured for connection to a window sash, and wherein the operator arm is movable between a closed configuration and an open configuration, and further wherein the operator arm comprises:

gear teeth arranged along an arcuate path at the first end of the operator arm, wherein the gear teeth mesh with the motor gear;

a pivot pin slot formed in the operator arm, wherein the pivot pin slot comprises a first end located closer to the first end of the operator arm than the second end of the operator arm and a second end located further away from the first end of the operator arm than the first end of the pivot pin slot;

a pivot pin operably attached to the housing, wherein the pivot pin is received in the pivot pin slot of the operator arm;

a lock operator operably attached to the housing, the lock operator configured for attachment to a sash lock assembly, the lock operator configured to move between a locked position and an unlocked position;

a drive rack operably attached to the operator arm;

a lock operator rack operably attached to the lock operator;

a drive rack gear configured to engage with the drive rack, wherein the drive rack gear is configured to rotate about a drive rack gear axis;

a lock operator gear configured to engage with the lock operator rack, wherein the lock operator gear is configured to rotate about a lock operator gear axis, and wherein rotation of the drive rack gear about the drive rack gear axis causes rotation of the lock operator gear about the lock operator gear axis;

wherein, when the operator arm is in the closed configuration and the lock operator is in the locked position, the drive rack gear is engaged with the drive rack and rotation of the motor gear in a first direction moves the operator arm along the operator arm axis relative to the housing such that the pivot pin moves within the pivot pin slot toward the first end of the pivot pin slot, wherein the drive rack rotates the drive rack gear about the drive rack gear axis as the pivot pin moves towards the first end of the pivot pin slot, wherein rotation of the drive rack gear by the drive rack rotates the lock operator gear about the lock operator gear axis, wherein rotation of the lock operator gear moves the lock operator rack in a direction aligned with the operator arm axis such that the lock operator moves from the locked position to the unlocked position as the pivot pin moves toward the first end of the pivot pin slot;

wherein further rotation of the motor gear in the first direction after the pivot pin reaches the first end of the pivot pin slot rotates the operator arm about the pivot pin at the first end of the pivot pin slot such that the operator arm moves from the closed configuration to the open configuration;

wherein rotation of the motor gear in a second direction when the operator arm is in the open configuration rotates the operator arm about the pivot pin at the first end of the pivot pin slot to move the operator arm from the open configuration to the closed configuration;

wherein further rotation of the motor gear in the second direction after moving the operator arm from the open configuration to the closed configuration moves the operator arm along the operator arm axis relative to the housing such that the drive rack moves in a direction aligned with the operator arm axis to engage with and rotate the drive rack gear about the drive rack gear axis, wherein rotation of the drive rack gear rotates the lock operator gear about the lock operator gear axis, wherein rotation of the lock operator gear moves the lock operator into the locked position.

2. The power window operator according to claim 1, wherein the drive rack gear axis and the lock operator gear axis are offset from each other in a direction transverse to the drive rack gear axis.

3. The power window operator according to claim 1, wherein the drive rack gear and the lock operator gear are attached to each other such that the drive rack gear axis and the lock operator gear axis are colinear with each other.

4. The power window operator according to claim 1, wherein, when the operator arm is in the closed configuration and the lock operator is in the locked position, the lock operator gear and the lock operator rack move the lock operator out of the locked position before the operator arm moves out of the closed configuration.

5. The power window operator according to claim 1, wherein, when the operator arm moves from the open configuration to the closed configuration, the lock operator gear and the lock operator rack move the lock operator to the locked position after the operator arm moves into the closed configuration.

6. The power window operator according to claim 1, wherein, when the operator arm is in the closed configuration and the lock operator is in the locked position, the drive rack gear, the drive rack, the lock operator gear, and the lock operator rack are configured to move the lock operator in a direction aligned with the operator arm axis at a faster rate than the operator arm moves along the operator arm axis as the lock operator moves from the locked position to the unlocked position.

7. The power window operator according to claim 1, wherein the drive rack gear and the lock operator gear define a gear ratio of the drive rack gear to the lock operator gear that is less than one.

8. The power window operator according to claim 1, wherein, when the operator arm is in the closed configuration and the lock operator is in the unlocked position, the drive rack engages with the drive rack gear after the operator arm moves along the operator arm axis such that the pivot pin moves out of the first end and toward the second end of the pivot pin slot in the operator arm as the lock operator moves toward the locked position.

9. The power window operator according to claim 1, wherein the power window operator comprises a hand crank that is selectively engageable with the motor gear such that, when the hand crank is selectively engaged with the motor gear, operation of the hand crank rotates the motor gear about the motor gear axis, and wherein, when the hand crank is not selectively engaged with the motor gear, rotation of the motor gear about the motor gear axis does not rotate the hand crank.

10. The power window operator according to claim 9, wherein the power window operator comprises a hand crank gear assembly configured to rotate the motor gear about the motor gear axis when the hand crank is rotated about a hand crank axis when the hand crank is selectively engaged with the motor gear.

11. The power window operator according to claim 10, wherein, when the hand crank is not engaged with the motor gear, rotation of the motor gear about the motor gear axis does not rotate the hand crank about the hand crank axis.

12. The power window operator according to claim 1, wherein rotation of the motor gear in the second direction after moving the operator arm from the open configuration to the closed configuration moves the operator arm along the operator arm axis relative to the housing such that the pivot pin slot moves along the pivot pin until the pivot pin is positioned at the second end of the pivot pin slot when the operator arm is in the closed configuration.

13. The power window operator according to claim 1, wherein movement of the lock operator between the locked position and the unlocked position is along a direction aligned with the operator arm axis when the operator arm is in the closed configuration and the pivot pin is located at the second end of the pivot pin slot.

14. A power window operator comprising:

a housing configured for attachment to a window frame;

a motor operably connected to a motor gear contained within the housing, the motor configured to rotate the motor gear about a motor gear axis;

an operator arm operably attached to the housing, the operator arm extending from a first end to a second end, wherein an operator arm axis extends through the first and second ends of the operator arm, wherein the second end of the operator arm is configured for connection to a window sash, and wherein the operator arm is movable between a closed configuration and an open configuration, and further wherein the operator arm comprises:

gear teeth arranged along an arcuate path at the first end of the operator arm, wherein the gear teeth mesh with the motor gear;

a pivot pin slot formed in the operator arm, wherein the pivot pin slot comprises a first end located closer to the first end of the operator arm than the second end of the operator arm and a second end located further away from the first end of the operator arm than the first end of the pivot pin slot;

a pivot pin operably attached to the housing, wherein the pivot pin is received in the pivot pin slot of the operator arm;

a lock operator operably attached to the housing, the lock operator configured for attachment to a sash lock assembly, the lock operator configured to move between a locked position and an unlocked position;

a drive rack operably attached to the operator arm;

a lock operator rack operably attached to the lock operator;

a drive rack gear configured to engage with the drive rack, wherein the drive rack gear is configured to rotate about a drive rack gear axis;

a lock operator gear configured to engage with the lock operator rack, wherein the lock operator gear is configured to rotate about a lock operator gear axis, and wherein rotation of the drive rack gear about the drive rack gear axis causes rotation of the lock operator gear about the lock operator gear axis;

wherein, when the operator arm is in the closed configuration and the lock operator is in the locked position, the drive rack gear is engaged with the drive rack and rotation of the motor gear in a first direction moves the operator arm along the operator arm axis relative to the housing such that the pivot pin moves within the pivot pin slot toward the first end of the pivot pin slot, wherein the drive rack rotates the drive rack gear about the drive rack gear axis as the pivot pin moves towards the first end of the pivot pin slot, wherein rotation of the drive rack gear by the drive rack rotates the lock operator gear about the lock operator gear axis, wherein rotation of the lock operator gear moves the lock operator rack in a direction aligned with the operator arm axis such that the lock operator moves from the locked position to the unlocked position as the pivot pin moves toward the first end of the pivot pin slot;

wherein further rotation of the motor gear in the first direction after the pivot pin reaches the first end of the pivot pin slot rotates the operator arm about the pivot pin at the first end of the pivot pin slot such that the operator arm moves from the closed configuration to the open configuration;

wherein rotation of the motor gear in a second direction when the operator arm is in the open configuration rotates the operator arm about the pivot pin at the first end of the pivot pin slot to move the operator arm from the open configuration to the closed configuration;

wherein further rotation of the motor gear in the second direction after moving the operator arm from the open configuration to the closed configuration moves the operator arm along the operator arm axis relative to the housing such that the drive rack moves in a direction aligned with the operator arm axis to engage with and rotate the drive rack gear about the drive rack gear axis, wherein rotation of the drive rack gear rotates the lock operator gear about the lock operator gear axis, wherein rotation of the lock operator gear moves the lock operator into the locked position;

wherein, when the operator arm is in the closed configuration and the lock operator is in the locked position, the lock operator gear and the lock operator rack move the lock operator out of the locked position before the operator arm moves out of the closed configuration;

wherein, when the operator arm moves from the open configuration to the closed configuration, the lock operator gear and the lock operator rack move the lock operator to the locked position after the operator arm moves into the closed configuration; and wherein, when the operator arm is in the closed configuration and the lock operator is in the locked position, the drive rack gear, the drive rack, the lock operator gear, and the lock operator rack are configured to move the lock operator in a direction aligned with the operator arm axis at a faster rate than the operator arm moves along the operator arm axis as the lock operator moves from the locked position toward the unlocked position.

15. A window comprising:

a window frame having a sash rotatable attached to the window frame, wherein the sash moves between a closed position in the window frame and an open position in the window frame;

wherein the window further comprises a power window operator comprising:

a housing attached to the window frame;

a motor operably connected to a motor gear contained in the housing, the motor configured to rotate the motor gear about a motor gear axis;

an operator arm extending from a first end to a second end, wherein an operator arm axis extends through the first and second ends of the operator arm, and wherein the second end of the operator arm is operably attached to the sash, and further wherein the operator arm comprises:

gear teeth arranged along an arcuate path at the first end of the operator arm, wherein the gear teeth mesh with the motor gear;

a pivot pin slot formed in the operator arm, wherein the pivot pin slot comprises a first end located closer to the first end of the operator arm than the second end of the operator arm and a second end located further away from the first end of the operator arm than the first end of the pivot pin slot;

a pivot pin operably attached to the housing, wherein the pivot pin is received in the pivot pin slot of the operator arm;

a lock assembly configured to lock the sash in the closed position when the lock assembly is in a locked configuration;

a lock operator configured to move along the window frame between a locked position and an unlocked position, and wherein the lock operator is operably attached to the lock assembly such that the lock assembly moves to the locked configuration when the lock operator moves to the locked position and the lock assembly moves to an unlocked configuration when the lock operator moves to the unlocked position;

a drive rack operably attached to the operator arm;

a lock operator rack operably attached to the lock operator;

a drive rack gear configured to engage with the drive rack, wherein the drive rack gear is configured to rotate about a drive rack gear axis;

a lock operator gear configured to engage with the lock operator rack, wherein the lock operator gear is configured to rotate about a lock operator gear axis, and wherein rotation of the drive rack gear about the drive rack gear axis causes rotation of the lock operator gear about the lock operator gear axis;

wherein, when the sash is in the closed position and the lock operator is in the locked position, the drive rack gear is engaged with the drive rack and rotation of the motor gear in a first direction moves the operator arm along the operator arm axis relative to the housing such that the pivot pin moves within the pivot pin slot toward the first end of the pivot pin slot, wherein the drive rack rotates the drive rack gear about the drive rack gear axis as the pivot pin moves towards the first end of the pivot pin slot, wherein rotation of the drive rack gear by the drive rack rotates the lock operator gear about the lock operator gear axis, wherein rotation of the lock operator gear moves the lock operator rack in a direction aligned with the operator arm axis such that the lock operator moves from the locked position to the unlocked position as the pivot pin moves toward the first end of the pivot pin slot, and wherein movement of the lock operator into the unlocked position moves the lock assembly to the unlocked configuration;

wherein further rotation of the motor gear in the first direction after the pivot pin reaches the first end of the pivot pin slot rotates the operator arm about the pivot pin at the first end of the pivot pin slot such that the sash moves from the closed position to the open position;

wherein rotation of the motor gear in a second direction when the sash is in the open position rotates the operator arm about the pivot pin at the first end of the pivot pin slot to move the sash from the open position to the closed position;

and wherein further rotation of the motor gear in the second direction after moving the sash from the open position to the closed position moves the operator arm along the operator arm axis relative to the housing such that the drive rack moves in a direction aligned with the operator arm axis to engage with and rotate the drive rack gear about the drive rack gear axis, wherein rotation of the drive rack gear rotates the lock operator gear about the lock operator gear axis, wherein rotation of the lock operator gear moves the lock operator into the locked position, and wherein movement of the lock operator into the locked position moves the lock assembly to the locked configuration.

16. The window according to claim 15, wherein the drive rack gear axis and the lock operator gear axis are offset from each other in a direction transverse to the drive rack gear axis.

17. The window according to claim 15, wherein the drive rack gear and the lock operator gear are attached to each other such that the drive rack gear axis and the lock operator gear axis are colinear with each other.

18. The window according to claim 15, wherein, when the sash is in the closed position and the lock operator is in the locked position, the lock operator gear and the lock operator rack move the lock operator out of the locked position before the sash moves out of the closed position.

19. The window according to claim 15, wherein, when the sash moves from the open position to the closed position, the lock operator gear and the lock operator rack move the lock operator to the locked position after the sash moves into the closed position.

20. The window according to claim 15, wherein, when the sash is in the closed position and the lock operator is in the locked position, the drive rack gear, the drive rack, the lock operator gear, and the lock operator rack are configured to move the lock operator in a direction aligned with the operator arm axis at a faster rate than the operator arm moves along the operator arm axis as the lock operator moves from the locked position to the unlocked position.

21. The window according to claim 15, wherein the drive rack gear and the lock operator gear define a gear ratio of the drive rack gear to the lock operator gear that is less than one.

22. The window according to claim 15, wherein, when the sash is in the closed position and the lock operator is in the unlocked position, the drive rack engages with the drive rack gear after the operator arm moves along the operator arm axis such that the pivot pin moves out of the first end and toward the second end of the pivot pin slot in the operator arm as the lock operator moves toward the locked position.

23. The window according to claim 15, wherein the power window operator comprises a hand crank that is selectively engageable with the motor gear such that, when the hand crank is selectively engaged with the motor gear, operation of the hand crank rotates the motor gear about the motor gear axis, and wherein, when the hand crank is not selectively engaged with the motor gear, rotation of the motor gear about the motor gear axis does not rotate the hand crank.

* * * * *